US009771882B2

(12) United States Patent
Repasky et al.

(10) Patent No.: US 9,771,882 B2
(45) Date of Patent: Sep. 26, 2017

(54) METHOD FOR FORMING A CONTROL FOR OPERATION OF A PORTABLE ENGINE POWERED DEVICE

(71) Applicant: Generac Power Systems, Inc., Waukesha, WI (US)

(72) Inventors: Michael Repasky, Jefferson, WI (US); Russell Saari, Janesville, WI (US); Glen Schneider, Evansville, WI (US); Gary Castaldo, Poplar Grove, IL (US); Jennifer Caldwell, Janesville, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 0 days.

(21) Appl. No.: 15/278,537

(22) Filed: Sep. 28, 2016

(65) Prior Publication Data

US 2017/0016406 A1 Jan. 19, 2017

Related U.S. Application Data

(62) Division of application No. 14/185,267, filed on Feb. 20, 2014, now Pat. No. 9,476,370.

(51) Int. Cl.
*F02D 33/00* (2006.01)
*F02D 11/02* (2006.01)
(Continued)

(52) U.S. Cl.
CPC ..... *F02D 33/006* (2013.01); *F02B 63/02* (2013.01); *F02B 63/044* (2013.01); *F02D 11/02* (2013.01);
(Continued)

(58) Field of Classification Search
CPC ..... F02D 9/02; F02D 11/02; F02D 33/003; F02D 33/006; F02D 2009/0205;
(Continued)

(56) References Cited

U.S. PATENT DOCUMENTS 1,461,521 A 7/1923 Forney et al.
2,136,500 A 11/1938 Griese et al.
(Continued)

FOREIGN PATENT DOCUMENTS

EP 0758430 5/1998
EP 2140984 8/2013
(Continued)

OTHER PUBLICATIONS

PCT/US2014/056481, International Search Report and Written Opinion dated Dec. 29, 2014, 11 pages.

*Primary Examiner* — Grant Moubry
(74) *Attorney, Agent, or Firm* — Boyle Fredrickson, S.C.

(57) ABSTRACT

A single control for manipulating a fuel valve, a choke condition, and an ignition system condition of an engine of a portable engine powered device that simplifies starting, stopping, and operation of the engine associated with use of the device. The control includes a dial that can be rotated to positions between a first radial position and a second radial position. When the dial is in the first radial position, the fuel valve is maintained in a closed position and the ignition system is grounded such that the engine is rendered inoperable. Rotation of the dial away from the first radial position completes the ignition circuit, opens the fuel valve, and initiates a choke position suitable for subsequent starting and self-sustained operation of the engine. The dial is also axially displaceable to activate an electronic starter for engines so equipped.

9 Claims, 19 Drawing Sheets

(51) Int. Cl.

| | |
|---|---|
| ***F02B 63/02*** | (2006.01) |
| ***F02N 3/02*** | (2006.01) |
| ***F02B 63/04*** | (2006.01) |
| *F02N 11/08* | (2006.01) |

(52) U.S. Cl.
CPC ..... *F02D 33/003* (2013.01); *F02N 3/02* (2013.01); *F02N 11/0803* (2013.01); *F02N 2200/10* (2013.01); *Y10T 29/49105* (2015.01)

(58) Field of Classification Search
CPC ..... F02D 2009/0208; F02D 2009/0245; F02D 2009/0249; F02B 63/02; F02B 63/044; F02N 11/0803; F02N 15/00; F02N 2200/10; Y10T 29/49105; Y10T 29/49599; Y10T 70/7085; Y10T 74/2014
USPC ..... 123/332, 179.1, 179.16, 179.18; 701/101, 103, 112, 113
See application file for complete search history.

(56) References Cited

U.S. PATENT DOCUMENTS

| | | | | |
|---|---|---|---|---|
| 3,511,220 | A * | 5/1970 | Otterbach | F02M 1/00 123/146.5 R |
| 4,274,378 | A | 6/1981 | Tate | |
| 4,304,737 | A | 12/1981 | Breckenfeld et al. | |
| 4,455,266 | A | 6/1984 | Gerhardy | |
| 4,462,945 | A | 7/1984 | Brown | |
| 4,895,114 | A | 1/1990 | Iida | |
| 6,408,805 | B2 | 6/2002 | Uenoyama et al. | |
| 6,516,779 | B2 | 2/2003 | Ikeda | |
| 6,564,761 | B2 | 5/2003 | Uenoyama et al. | |
| 6,729,276 | B2 | 5/2004 | Uenoyama et al. | |
| 6,857,410 | B2 * | 2/2005 | Davis | F01B 1/12 123/195 R |
| 6,871,623 | B2 | 3/2005 | Ohsawa et al. | |
| 6,938,634 | B2 | 9/2005 | Dewey, Jr. | |
| 7,055,506 | B2 | 6/2006 | Kaiser et al. | |
| 7,252,063 | B2 * | 8/2007 | Mazuka | F02B 63/04 123/179.18 |
| 7,337,765 | B2 | 3/2008 | Tanaka et al. | |
| 7,432,606 | B2 | 10/2008 | Yamamoto et al. | |
| 7,549,403 | B2 | 6/2009 | Yamamoto et al. | |
| 7,681,544 | B2 | 3/2010 | Reed | |
| 7,705,478 | B2 | 4/2010 | Hirose et al. | |
| 8,232,777 | B2 | 7/2012 | Hashimoto et al. | |
| 8,240,639 | B2 | 8/2012 | Roth | |
| 8,424,853 | B2 | 4/2013 | Wenckel et al. | |
| 8,469,001 | B2 | 6/2013 | Yoshizaki et al. | |
| 8,489,310 | B2 | 7/2013 | Shimamura et al. | |
| 8,586,886 | B2 | 11/2013 | Nemetz et al. | |
| 8,590,516 | B2 | 11/2013 | Hull et al. | |
| 8,598,723 | B2 | 12/2013 | Hashizume et al. | |
| 8,618,681 | B2 | 12/2013 | Yamamura et al. | |
| 8,653,931 | B2 | 2/2014 | Xu et al. | |
| 8,667,933 | B2 | 3/2014 | Grether et al. | |
| 8,695,950 | B2 | 4/2014 | Takesue | |
| 8,716,984 | B2 | 5/2014 | Mueller et al. | |
| 8,726,882 | B2 | 5/2014 | Raasch | |
| 8,727,233 | B2 | 5/2014 | Karp | |
| 8,731,805 | B2 | 5/2014 | Bungo | |
| 8,733,072 | B2 | 5/2014 | Hansen et al. | |
| 8,746,207 | B2 | 6/2014 | Drew et al. | |
| 8,766,603 | B2 | 7/2014 | Hashimoto | |
| 2001/0013664 | A1 | 8/2001 | Kobayashi | |
| 2001/0023711 | A1 * | 9/2001 | Gnudi | B60K 15/06 137/590 |
| 2004/0025817 | A1 | 2/2004 | Uenoyama et al. | |
| 2012/0282027 | A1 | 11/2012 | Nick et al. | |
| 2013/0123067 | A1 | 5/2013 | Cunningham et al. | |
| 2014/0119949 | A1 | 5/2014 | Wischstadt et al. | |
| 2014/0174393 | A1 | 6/2014 | Turner et al. | |

FOREIGN PATENT DOCUMENTS

| | | |
|---|---|---|
| GB | 1199117 | 7/1970 |
| JP | 9-291852 | 11/1987 |
| JP | 61-275566 | 12/1988 |
| JP | 11-82082 | 3/1999 |
| JP | 2002-309959 | 10/2002 |
| JP | 2003-120314 | 4/2003 |
| JP | 20077239545 | 9/2007 |
| JP | 4264412 | 5/2009 |
| KR | 100719646 | 5/2007 |
| WO | 2014105675 | 7/2014 |

* cited by examiner

METHOD FOR FORMING A CONTROL FOR OPERATION OF A PORTABLE ENGINE POWERED DEVICE

CROSS-REFERENCE TO RELATED APPLICATION

The present application is a divisional of application Ser. No. 14/185,267 filed Feb. 20, 2014.

FIELD OF THE INVENTION

The present invention relates generally to portable internal combustion engine powered devices, and in particular, to a control assembly whose operation concurrently manipulates more than one of a fuel shut-off valve, an engine choke control, an engine ignition circuit control, and preferably operation of an electronic starting system associated with operation of the internal combustion engine of such engine powered devices.

BACKGROUND OF THE INVENTION

Portable internal combustion engines are used in a wide variety of applications, such as lawn mowers, snow blowers, chain saws, electrical generators, pressure or power-washers, etc. It is appreciated that such devices can commonly be provided a manual start configuration and/or an electric start configuration. Those skilled in the art will appreciate that manual start engines often include a recoil assembly and that power or electric starting systems commonly include an electric starter, the respective operation of which generates the initial compression cycle associated with self-sustainable operation of the underlying engine. Some engine powered devices are provided with both manual and electric starting systems to improve the redundancy with which the user is able to start the underlying engine.

As those skilled in the art can attest, starting and maintaining operation of the internal combustion engine of many portable engine driven devices commonly requires user interaction with various discrete controls associated with starting and operating the internal combustion engine during different conditions. Many portable engine powered devices, whether equipped in a manual or electronic starting configuration, require sequential user interaction with various controls to effectuate starting and maintaining operation of the engine. The sequence and relative degree of operation of these various controls also frequently varies as a function of ambient and contemporaneous conditions associated with operation of the internal combustion engine as explained further below.

Manually started engines commonly include an ON/OFF switch or key switch associated with communicating an electrical signal to a spark plug during operation of the recoil as well as operation of the engine after the engine has started. Such engine ignition systems commonly provide a shunt, fault, or ground connection associated with turning the engine OFF as the fault suspends generation of the spark signal. The internal combustion engine cannot be started during operation of a recoil or a starter when the fault condition exists. Accordingly, one aspect of starting any engine is to attend to the electrical ignition system of the engine, to ensure a spark signal will be generated during operation of the recoil or starter.

Another consideration to ensure efficient or expeditious starting of the engine is the communication of a desired charge of a combustion charge to the combustion chamber.

Many portable engine powered devices include a manually operable fuel valve and one or more of a choke or choke control, a primer or primer control, and/or an engine throttle control that can each contribute to manipulation of the respective ratio of fuel to air associated with the combustion charge. That is, manipulation of a fuel valve and any of the fuel or combustion charge flow controls alters the amount of fuel and/or air provided to the combustion chamber and/or the throttle assembly and affects starting and/or subsequent self-sustained operation of the underlying engine. Failure to properly attend to the fuel valve, choke, throttle, and/or primer controls can prolong the efforts associated with starting the engine.

Commonly, the controls associated with user interaction with the ignition system, choke, throttle, primer, and/or fuel valve systems are disposed in various discrete positions about the underlying device. For instance, many such devices include a fuel valve disposed near the outlet of the fuel reservoir or tank, an ignition system control—frequently simply one or more ON/OFF keys or switches, are commonly disposed on a dashboard or side surfaces of the device, and choke controls that are commonly disposed proximate a dashboard or the throttle assembly associated with operation of the underlying engine. Devices equipped with power starting systems can also occasionally include respective first and second switches that are associated with completing the ignition signal circuit and selective activation of the electric, starter. Efficient starting of the engine associated with such devices includes a requisite degree of familiarity with the desired sequence and direction of operation of each of the controls as well as the location of the discrete controls relative to the underlying device.

Further complicating engine starting performance, the user must also consider the current or recent engine operating conditions in addition to the location and manipulation of the ignition and fuel controls discussed above. For instance, when attempting to start a "cold" engine or engine that has not be operated for some duration, it is commonly necessary to choke the throttle and/or prime the engine. Once the engine turns over under its own power, the user must commonly manipulate one or more of the choke, the throttle, and/or a primer to maintain self-sustained operation of the engine. Failure to properly attend to one or more of the choke, throttle, and/or primer controls in a manner and/or sequence specific to the operating characteristics associated with the engine can result in "flooding" of the engine or a condition wherein too much fuel or too rich of a combustion charge is present in the combustion chamber to effectuate starting and sustained operation of the engine. Although a flooded engine can commonly be started with subsequent starting efforts—such as manipulation of the fuel and throttle controls and pulling of the recoil or activation of the starter, recovering from a flooded engine condition only frustrates a user's ability to expeditiously start the affected engine.

For those conditions where an engine has been operated for a sufficient duration so as to "warm-up" or even reach a normal operating temperature, subsequent starting sequences are not commonly the same as the cold engine starting sequence. That is, a warm engine will commonly start with no or only minimal manipulation of any of the choke and/or throttle systems front a normal operating orientation. The various nuances associated with engine starting sequences, the various locations associated with generation of the spark electronic signal, priming, choke, and/or throttle controls, and the desired sequencing associated with the manipulation of such controls can frustrate the ability of even experienced user's to efficiently start an engine associated with many portable engine powered devices.

Suitable user interaction with the various controls, particularly novice or first time users or even users who have not started or operated the respective devices for an extended period, commonly requires user inspection of the entirety of the device to gain or regain understanding of the location, direction of operation, sequence of operation, and/or the range of motion associated with each of the respective controls. Failure to adequately understand the respective orientation and sequencing of the various engine operating controls can result in the undesirable flooding of the engine and/or self-sustained but less than efficient operation of the underlying engine.

Therefore, there is a need for a control assembly for portable engine powered devices that is convenient and easy to understand and which manipulates more than one of the ignition and fuel system controls to simplify starting, stopping, and self-sustained operation of the internal combustion engine.

SUMMARY OF THE INVENTION

The present invention is directed to a control or control assembly or system for an internal combustion engine that overcomes one or more of the drawbacks mentioned above. One aspect of the invention discloses a single control for manipulating a fuel valve, a choke condition, and an ignition system condition of an engine associated with a portable engine powered device for simplifying starting, stopping, and achieving self-sustained operation of the engine associated with use of the device. The control includes a dial that can be rotated to positions between a first radial position and a second radial position. When the dial is in the first radial position, the fuel valve is maintained in a closed orientation and the ignition system is shunted or grounded such that the engine is rendered inoperable. Rotation of the dial away from the first radial position closes the ignition circuit, opens the fuel valve, and initiates a choke or throttle position suitable for subsequent starting and self-sustained operation of the engine. The dial is also preferably axially displaceable to activate an electronic starter for engines so equipped. Such a control provides a single input for user interaction with the engine.

Another aspect of the invention that is useable or combinable with one or more of the above aspects discloses a control assembly for manipulating operation of an internal combustion engine. The control assembly includes a dial that is rotatable about an axis of rotation. A barrel is engaged with the dial such that rotation of the dial through a range of rotation associated with the axis of rotation causes rotation of the barrel about the axis of rotation. The barrel is further constructed to engage an elongated connector that extends between the barrel and a throttle body associated with an internal combustion engine. The control assembly includes an extender having a first portion that is engaged with the barrel and a second portion that is engaged with a fuel shut-off valve. The extender is associated with the fuel shut-off valve such that rotation of the extender affects a position of the fuel shut-off valve. The extender is also associated with the barrel such that the extender rotates for at least a portion of the range of rotation of the barrel and so that the barrel and extender are axially movable relative to one another. In another aspect, the extender can rotate in response to rotation of the barrel throughout the entire range of rotation of the barrel.

Another aspect of the invention useable with one or more of the above aspects discloses a portable engine powered device that includes an internal combustion engine, a fuel tank, and a fuel shut-off valve that is disposed between the engine and the fuel tank. The portable engine powered device includes an elongate connector having a first end connected to a choke assembly of the internal combustion engine and a second end that is offset from the first end. The portable engine powered device includes a manual control for manipulating operation of the internal combustion engine. The manual control includes a first body that is movable in a rotational direction and an axial direction and is connected to the second end of the elongate connector such that rotation of the first body through a range of rotation bounded by a first radial position and a second radial position manipulates a position of the first end of the elongate connector. A second body is operatively associated with the first body and the fuel shut-off valve. The first body and the second body are axially slidably associated with one another and rotationally cooperate with one another such that rotation of the first body manipulates a rotational position of the second body during at least a portion of a range of rotation of the first body such that the second body manipulates a fluid conducting condition of the fuel shut-off valve.

Another aspect of the invention useable or combinable with one more or more of the above aspects discloses a method of forming a control for operation of a portable engine powered device. The method includes providing a single user input that is rotatable between a first radial position and a second radial position. The first radial position of dial is associated with grounding an engine ignition circuit, a closed orientation of a fuel valve, and an open choke condition. The second radial position of the single user input is associated with closing the engine ignition circuit, opening of the fuel valve, and a closed choke condition for subsequent cold starting of an internal combustion engine. Preferably, positions offset from the first radial position and the second radial positions are associated with steady state self-sustained operation of the underlying engine.

Another aspect of the invention usable with one or more of the above aspects discloses a single user input or engine control wherein the first body or barrel slidably cooperates with the second body or extender such that translation of the barrel relative to the extender actuates a starter circuit associated with operation of an electric starter for engines so equipped. Utilization of control assemblies as disclosed above allows the user to interact with the engine shutoff control, choke control, and/or electric engine starting systems via interaction with a single user input to provide convenient, efficient and repeatable interaction with the fuel and ignition systems of the underlying engine powered device.

Other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof and the invention includes all such modifications.

BRIEF DESCRIPTION OF THE DRAWINGS

The drawings illustrate the best mode presently contemplated of carrying out the invention. In the drawings.

DETAILED DESCRIPTION OF THE DRAWINGS

Figure 1:
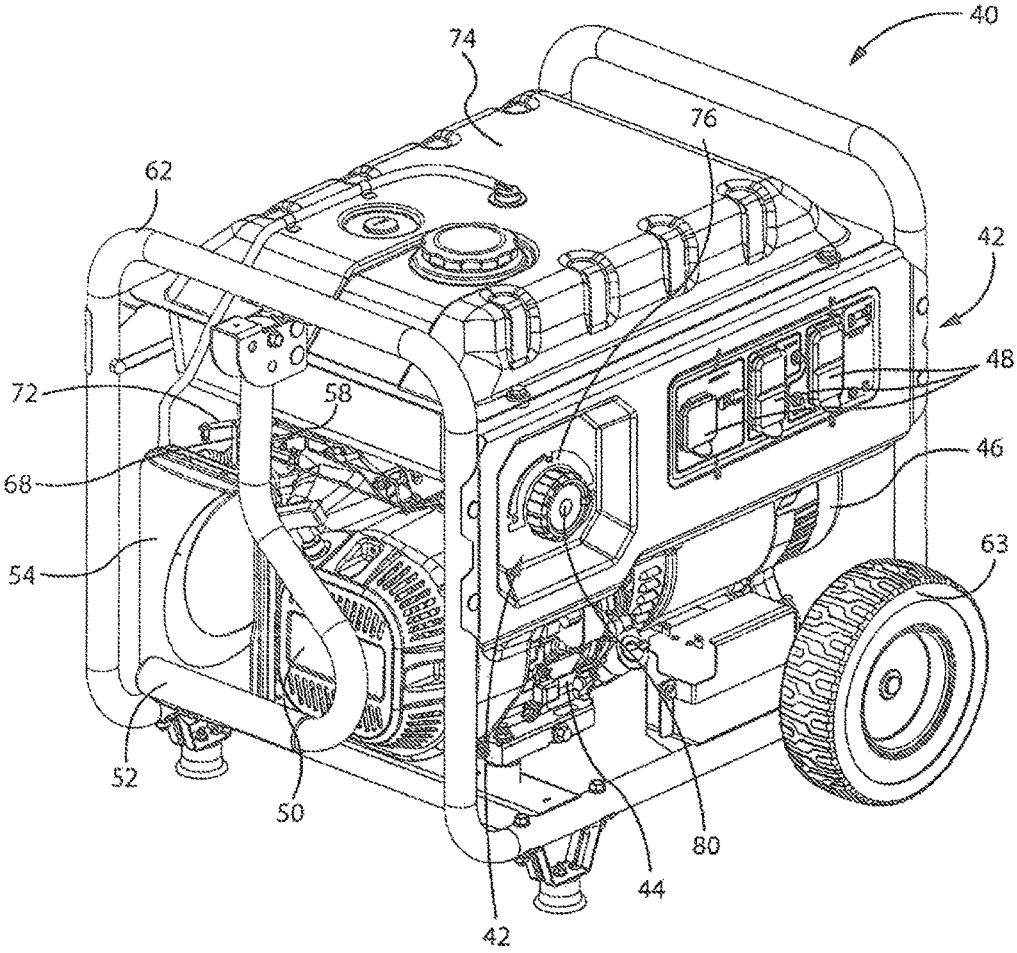
FIG. 1 is a perspective view of a portable engine powered device equipped with an engine control according to the present invention.

FIG. 1 shows a portable engine powered device 40 that is equipped with a start control, manual control, single user input, engine control, engine control assembly, or control assembly 42 according to the present invention. As disclosed herein, control assembly 42 is constructed to manipulate a configuration of fuel valve assembly, a configuration of a choke assembly associated with a throttle assembly, and an ignition system of an engine associated with the underlying device 40 in a manner that facilitates efficient and repeatable interaction with the various systems associated with the underlying engine and in a manner that accommodates starting, stopping, and operation of the engine in a manner that appreciates a different conditions associated with operation of the engine.

Referring to FIG. 1, device 40 includes an internal combustion engine 44 that is connected to an output device, such as an alternator or electrical generator 46, which is powered by operation of engine 44. Generator 46 is connected to one or more electrical outputs or outlets 48 that are configured to communicate a desired electrical signal to an auxiliary tool, device, or system intended to be powered by operation of device 40. Although shown as a generator, it is appreciated that engine 44 could be connected to any of a number of output devices, such as a pump and/or drive train when device 40 is provided in other configurations such as a power washer or other configurations when the output device is configured for cutting, trimming applications, or a device configured for snow blowing as but a few examples of equipment commonly powered by an internal combustion engine. It is appreciated that the examples provided above are not all-inclusive of the industries and devices usable with the present invention.

Engine 44 of device 40 is operatively connected to a start device 50, such as a starter or a recoil. In the configuration shown in FIG. 1, device 40 includes a recoil 50 associated with manual starting of engine 44. It is appreciated that device 40 could be provided with one or both of a starter and a recoil 50. As commonly understood with such manual start devices 50 as shown in FIG. 1, user interaction with a handle 52 of recoil 50 causes rotation of the engine crank to generate an initial compression cycle associated with starting of the engine. Engine 44 includes an air intake 54 that is connected to a carburetor, throttle body, or throttle assembly 56. Air intake 54 is configured to communicate a combustion gas or air to engine 44 and preferably includes a filter or other such device to prevent dirt, dust or debris from passing into engine 44. A spark plug, indicated by spark plug wire 58, is exposed to a combustion chamber of engine 44 and is configured to provide an ignition signal to the combustion charge delivered to the combustion chamber. As is commonly understood, the volume and fuel/air ratio delivered to the combustion chamber are manipulated to effectuate starting of the engine under different conditions and the subsequent steady state or self supported operational speed of engine.

Device 40 includes a muffler or exhaust (not visible) that receives the combustion byproducts and discharges the combustion byproducts from engine 44. Preferably, device 40 includes a chassis, space-frame 62, or possibly a full enclosure that generally defines a footprint of device 40 in order to prevent incidental contacts with the operating components of the device as well as to provide convenient grip locations associated with manual transport of device 40. Alternatively, it is appreciated that device 40 can include one or more handles 61 that cooperate with space-frame 62 in a fixed or collapsible manner to assist with user transport of device 40. One or more wheels 63 can also be connected to space-frame 62 to facilitate at least partial ground supported transport of device 40. Although shown as a generally open structure, it is further appreciated that space-frame 62 can be provided in any number of shapes and/or include a number of removable panels configured to more generally enclose the operating components of device 40 without interfering with user interaction with the operable components of the device such as control assembly 42 and/or handle 52 of recoil 50.

As is commonly understood, user manipulation of throttle and/or choke controls as well as the ignition system associated with operation of the spark plug and operation of recoil 50 via handle 52 effectuates starting and operation of engine 44 and thereby operation or utilization of the output device or generator 46. It should also be appreciated that throttle assembly 56 can include one or more movable choke and/or throttle plates associated with selectively manipulating the fuel/air ratio associated with the combustion charge. It is also appreciated that throttle assembly 56 can be constructed to include only a choke plate whose position can be adjusted to facilitate cold starting and steady state operation of engine 44. Throttle assembly 56 is constructed to accommodate steady state full operational speed of engine 44 when the choke plate is fully open when provided in such a configuration.

Figure 24:
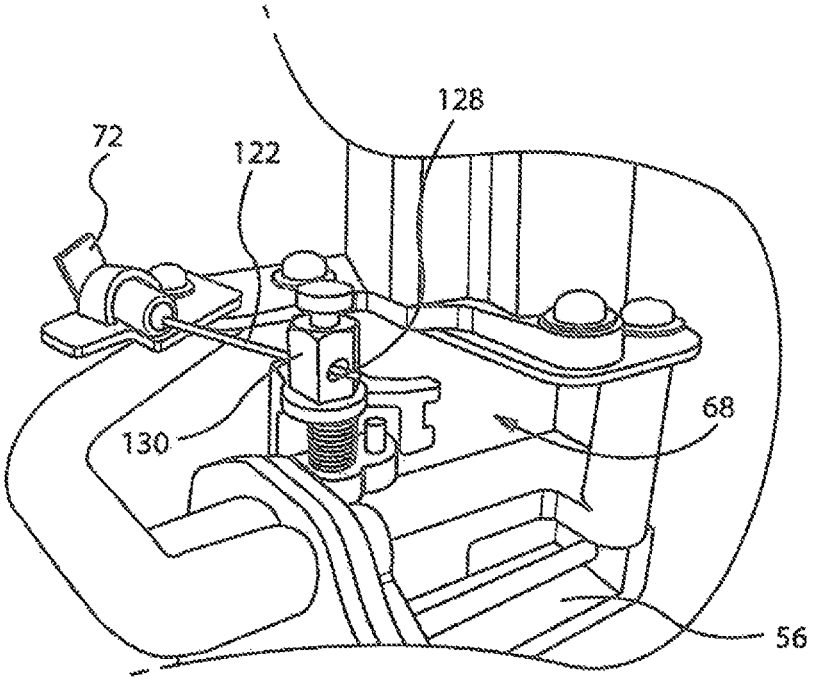
FIG. 24 is a partial perspective view of a throttle assembly of the engine powered device shown in FIG. 1 engaged with a second end of the elongate connector or choke cable shown in FIGS. 5 and 23.

Throttle assembly 56 includes a choke control linkage 68 (FIGS. 1 and 24) and can include an optional automatic or manual throttle control linkage associated with communicating a desired combustion charge to the combustion chamber of engine 44. As explained further below, choke control linkage 68 is connected to control assembly 42 via a choke cable 72 to allow a user to manually manipulate the orientation of a choke plate relative to throttle assembly 56. As commonly understood, closing the choke plate associated with throttle assembly 56 facilitates delivery of the richest fuel/air combustion charge to engine 44 for cold starting of the engine wherein the open choke plate configuration is usually associated with steady state operating temperature utilization of engine 44. Engine 44 can include a throttle control linkage that can be manually adjusted to manipulate the orientation of a throttle plate and/or be automatically adjusted in response to the operating condition of engine 44. As is commonly understood, the manipulation of the one or more plates associated with throttle assembly 56 manipulates the fuel/air ratio associated with the various stages of starting and/or extended operation or running of engine 44.

Device 40 includes a fuel reservoir or tank 74 constructed to contain a volume of fuel associated with operation of engine 44. Preferably, tank 74 is contained within a perimeter defined by space-frame 62 to mitigate unintended impact or contact with tank 74. Although shown as what is commonly understood as an unpressurized liquid fuel tank, it is further appreciated that device 40 could be constructed for operation with utilization of a pressurized fuel source such as a liquid propane (LP) tank. It is appreciated that those skilled in the art appreciate the alternative configurations associated with operation of engine 44 and throttle assembly 56 for use with the respective pressurized and unpressurized fuel sources.

Figure 2:
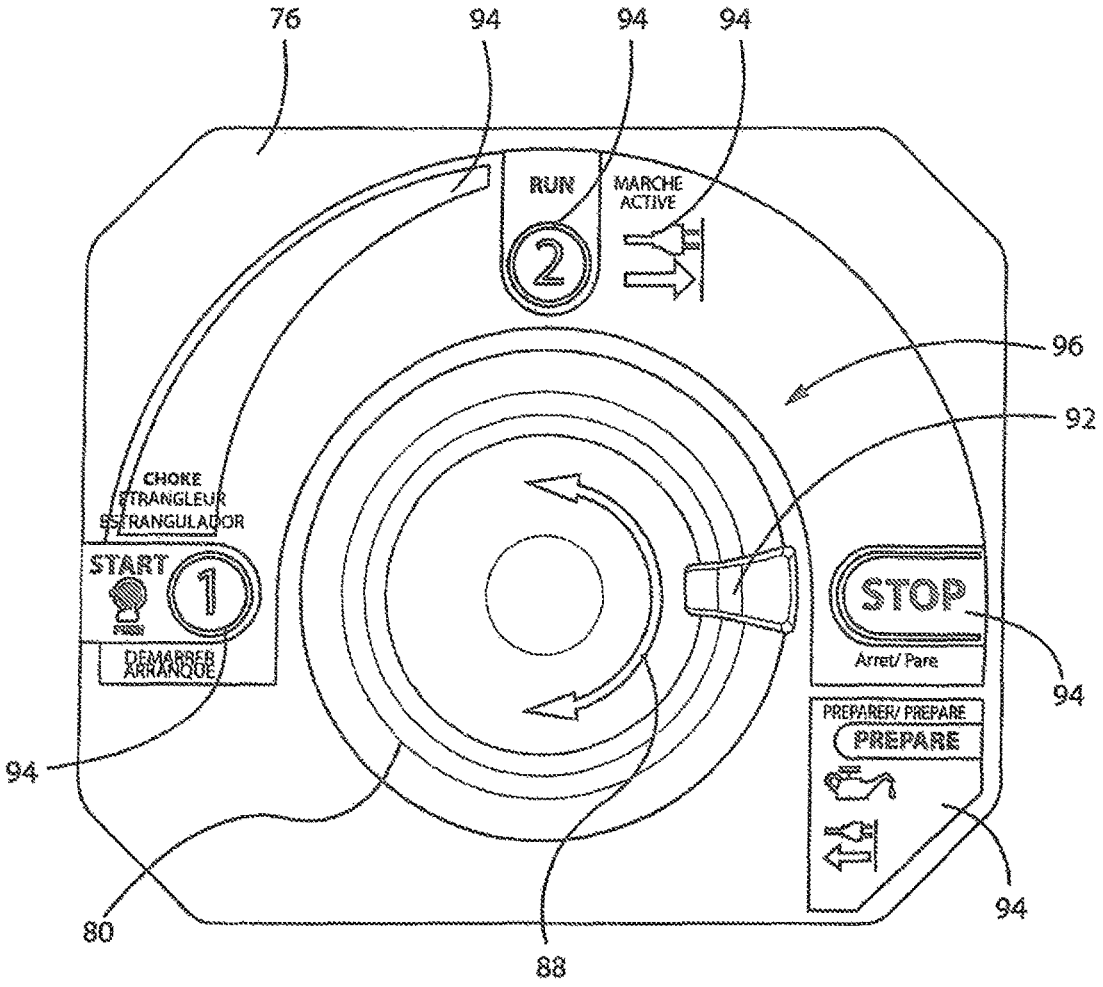
FIG. 2 is a top plan view of the control system shown in FIG. 1 with a single user input in the form of a dial in a first position relative to an indicia that provides an indication of the operating condition of the device.
Figure 3:
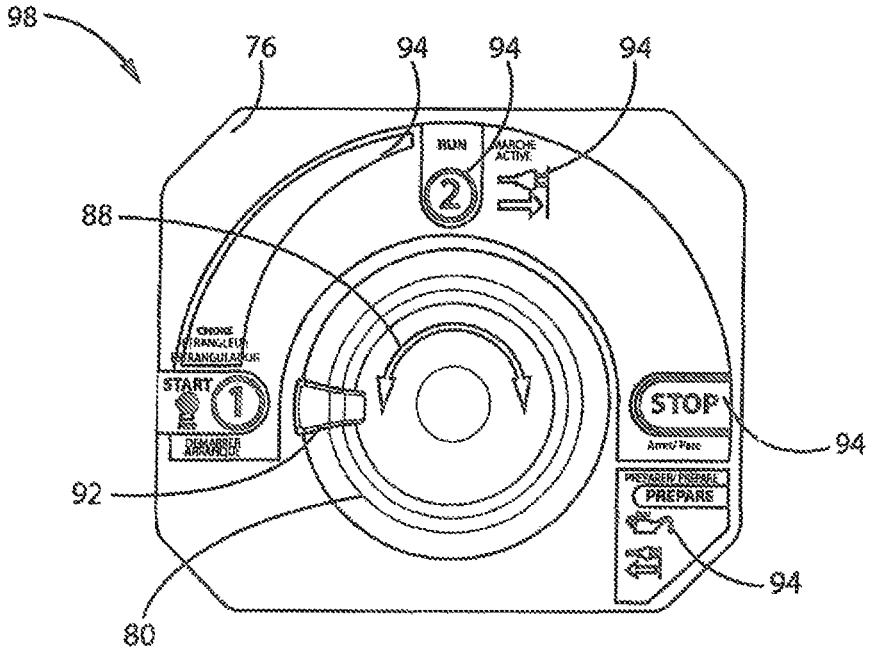
FIG. 3 is a view similar to FIG. 2 of the single user input with the dial rotated to a second position.
Figure 4:
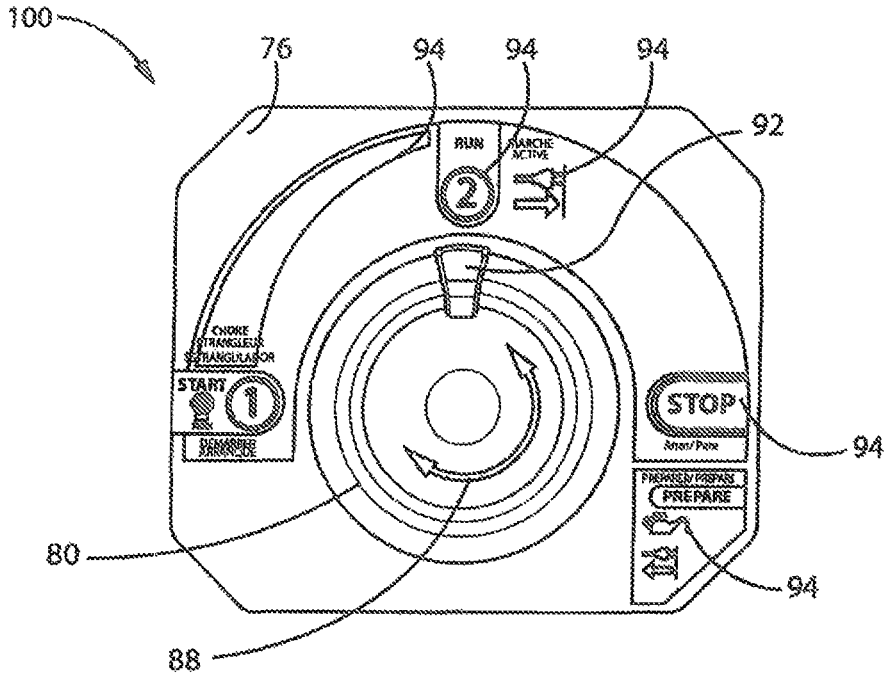
FIG. 4 is a view similar to FIGS. 2 and 3 of the single user input with the dial rotated to an intermediary position.

Referring to FIGS. 1-5, control assembly 42 is associated with a control area or dashboard 76 of device 40 and includes a single user input in the form of a knob or dial 80 whose orientation manipulates choke, ignition, fuel supply connectivity, and start functions associated with operation of engine 44. Referring to FIGS. 2-4, dial 80 is rotatable, as indicated by arrow 88, and is movable in an axially or longitudinal direction relative to the axis associated with rotation 88, indicated by arrow 90 (FIG. 5), to facilitate the desired manipulation or interaction with the ignition, choke control, fuel valve, and optional electronic starter control associated with operation of engine 44. Still referring to FIGS. 2-4, dial 80 includes an indicator 92 that is positionally fixed relative to dial 80. Dial 80 of control assembly 42 cooperates with dashboard 76 and a plurality of indicia 94 associated therewith such that indicator 92 and indicia 94 cooperate with one another to provide a visual, tactile, or other indication as to the position of dial 80 relative to the operational or control associated with operation of engine 44.

Dial 80 is rotatable between a first or stop rotational orientation or position 96 (FIG. 2), a second or full choke or cold start rotational orientation or position 98 (FIG. 3), and rotational positions therebetween or intermediary or "RUN" rotational positions 100 (FIG. 4). As disclosed further below, stop rotational position 96 of control assembly 42 is associated with engine ignition and fuel valve OFF configurations and cold start rotational position 98 is associated with an open fuel valve configuration, completion or an ON configuration of the ignition system, and a full choke configuration of throttle assembly 56 associated with cold starting of engine 44. Run positions 100 are associated with partially or preferably fully OPEN fuel valve positions, partially or fully open choke conditions, and closed or ON ignition circuit conditions. Said in another way, intermediary positions 100 are associated with steady state self-supported or "RUN" operation of engine 44. As is also explained further below with respect to FIGS. 21 and 22, when rotationally offset from stop rotational position 96, dial 80 is also movable in the axial or longitudinal direction 90 along the axis associated with rotation of dial 80 between a first longitudinal position and a second longitudinal position to effectuate selective operation of an electric starter when device 40 is so equipped as disclosed above.

Figure 5:
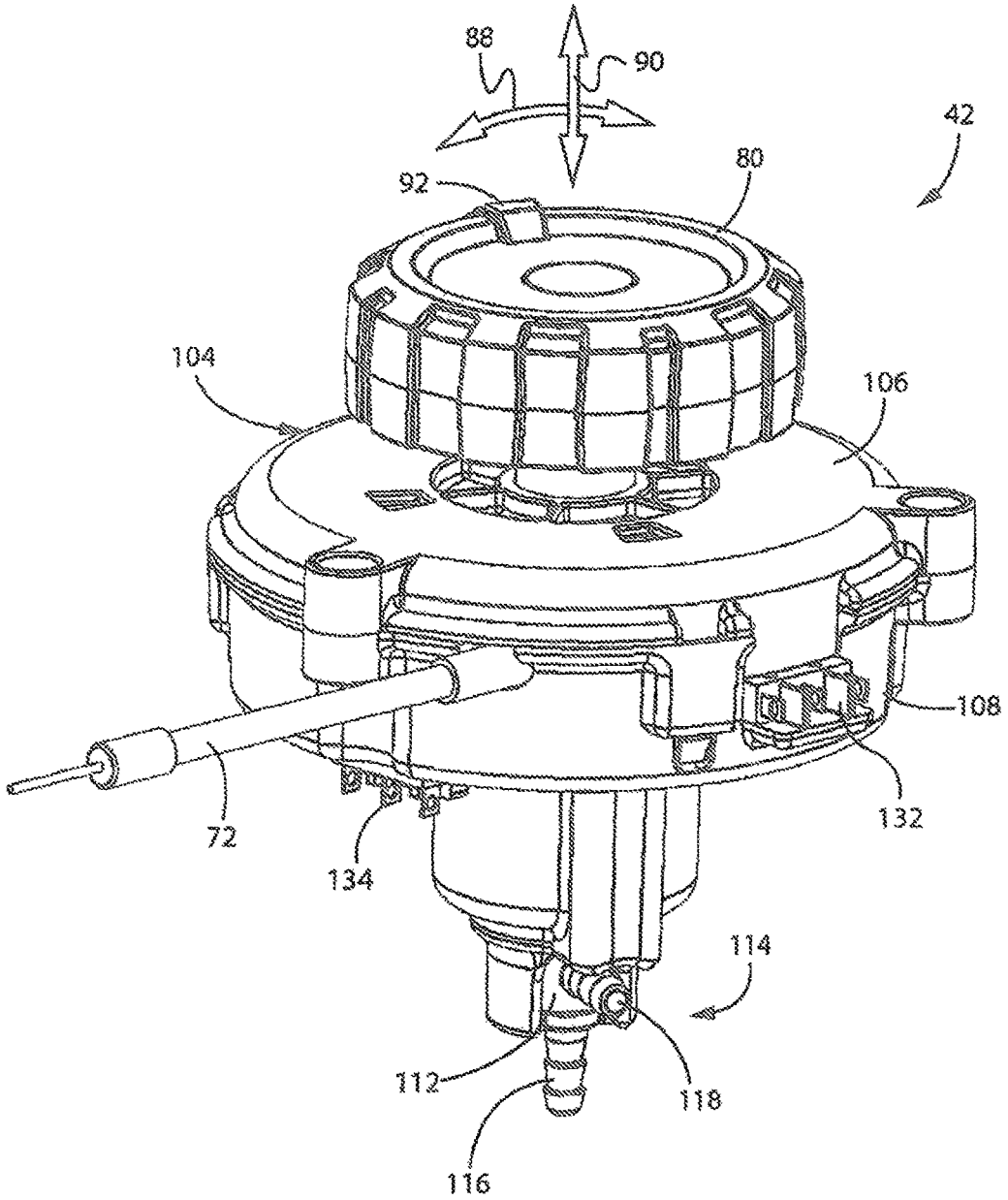
FIG. 5 is a perspective view of the engine control shown in FIG. 1 with the choke cable extending therefrom but otherwise removed from the underlying device.
Figure 6:
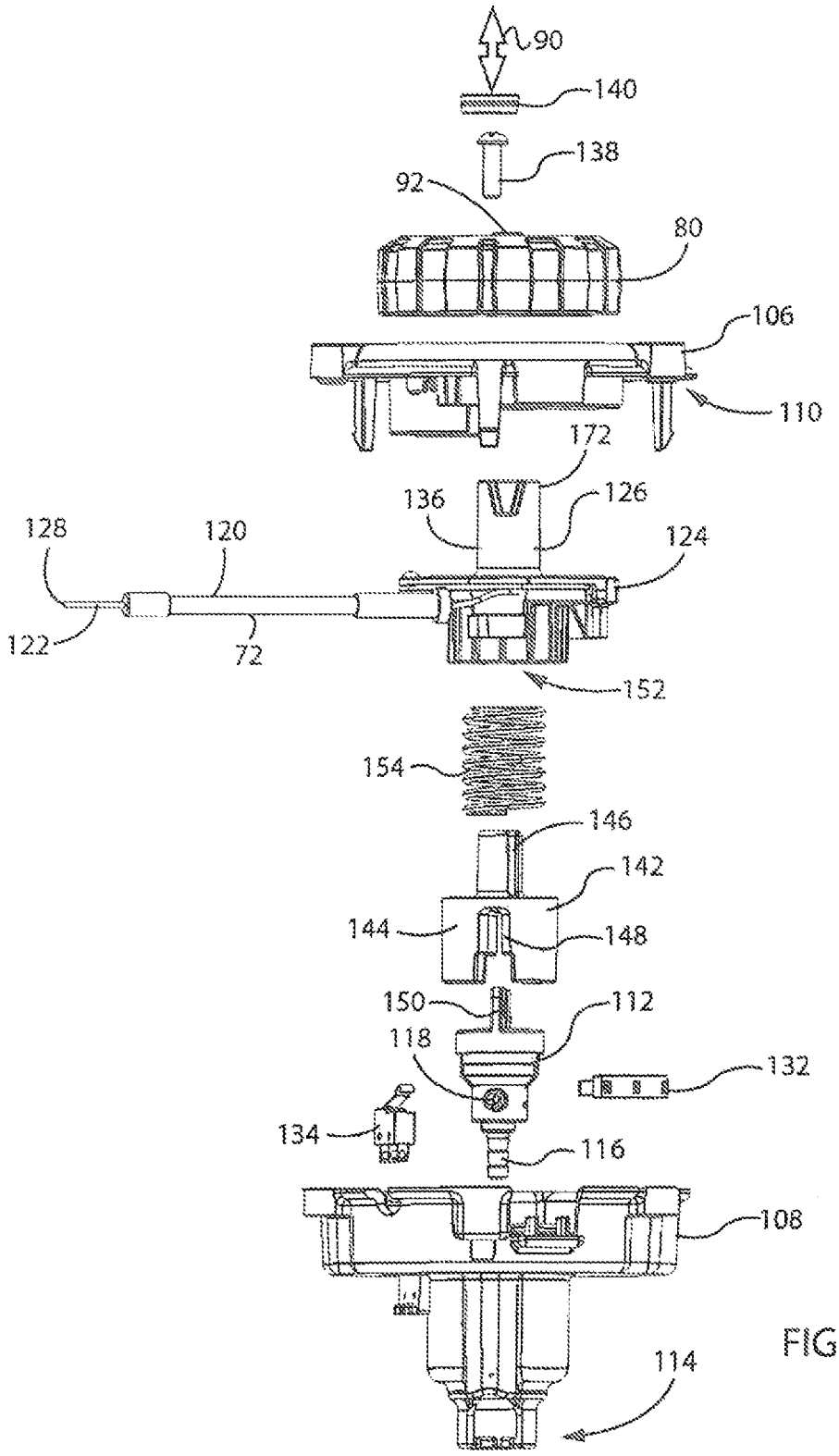
FIG. 6 is an exploded view of the engine control shown in FIG. 5.

Referring to FIGS. 5 and 6, control assembly 42 is shown removed from device 40 and the dashboard 76 associated therewith. Choke cable 72 is shown extending from control assembly 42 but can be separated therefrom with disassembly of control assembly 42. A gap 104 is provided between dial 80 and a cover 106 of control assembly 42. Preferably, gap 104 extends a distance sufficient to allow cooperation of dashboard 76 between dial 80 and cover 106 in a manner that does not interfere with a desired degree of axial translation of dial 80 for actuation of an electric starter or electric starting devices. As explained further below, dial 80 is preferably biased in an outward axial direction away from cover 106 until a user depresses dial 80 toward cover 106, or dashboard 76, to activate the electric starter of devices so equipped.

Still referring to FIGS. 5 and 6, control assembly 42 includes a base 108 that cooperates with an underside 110 of cover 106 or a side of cover 106 that is generally opposite dial 80. A fuel valve or fuel valve assembly 112 extends beyond the lower end 114 of base 108. Fuel valve assembly 112 includes a pair of barbs 116, 118 that are exposed to atmosphere and constructed to slidably but securely cooperate with respect to fuel lines that extend between fuel tank 74 and throttle assembly 56. A clamp or spring clip is commonly utilized to secure the respective fuel lines to a respective barb 116, 118. As is commonly understood, fuel valve assembly 112 is commonly operable to provide alternate fuel "ON" and fuel "OFF" fluid connections between tank 74 and throttle assembly 56.

An elongated connector such as choke cable 72 cooperates with control assembly 42 so that a portion of the choke cable 72 extends beyond control assembly 42 and can be operatively connected to throttle assembly 56. Choke cable 72 includes a sheath 120 and an elongated connector 122 that is slidably associated therewith. A first end 124 choke cable 72 is operatively connected to a first body or barrel 126 of control assembly 42 and a second end 128 of choke cable 72 is constructed to be secured to choke assembly 130 (FIG. 24) associated with the respective orientation of the choke plate relative to throttle assembly 56. Control assembly 42 includes a first or stop circuit switch 132 and an optional second or starter circuit or start switch 134 that are supported by base 108. As explained further below, switches 132, 134 are operable via respective rotational and axial cooperation with barrel 126 to manipulate the respective ON/OFF functionality of the circuits or devices associated with.

Referring to FIG. 6, barrel 126 includes a stem portion or simply stem 136 that extends through cover 106 and cooperates with dial 80. Stem 136 slidably cooperates with cover 106 such that barrel 126 is axially and rotationally movable relative thereto. A fastener 138 passes partially through dial 80 and cooperates with stem 136 so as to secure dial 80 thereto. Dial 80 is constructed to cooperate with a dust cap 140 that can be disposed over fastener 138 so as to enhance the aesthetic appearance associated therewith.

Control assembly 42 includes a second body or extender 142 that is defined by a first portion 144 and a second portion 146. First portion 144 of extender 142 includes a recess or slot 148 that is shaped to cooperate with a handle 150 of fuel valve assembly 112. Second portion 146 of extender 142 has a generally elongated shape that slidably cooperates with a cavity 152 formed in barrel 126 as explained further below. Second portion 146 of extender 142 cooperates with cavity 152 of barrel 126 such that rotation of barrel 126 rotates extender 142 for at least a portion of the range of rotation of barrel 126. As explained further below with respect to FIGS. 12-16, barrel 126 and extender 142 can be configured to cooperate in a manner wherein any rotation of barrel 126 rotates extender 142, or, as disclosed further below with respect to FIGS. 27-30, configured to cooperate in a manner wherein the extender rotates in response to rotation of the barrel for a portion of a range of rotation of the barrel and the barrel is allowed to rotate relative to the extender without manipulating the radial orientation of the extender for another portion of the range of rotation of the barrel. Regardless of the rotational cooperation, each configuration includes a biasing device, such as the spring 154, that cooperates with barrel 126 and extender 142 such that barrel 126 and extender 142 are biased in opposite axial directions 90 relative to one another. Spring 154 maintains the generally upward or outward orientation of dial 80 relative to cover 106 as disclosed above but the bias associated therewith can be overcome to allow a user to depress dial 80 such that barrel 126 moves in a downward axial direction toward extender 142.

Figure 7:
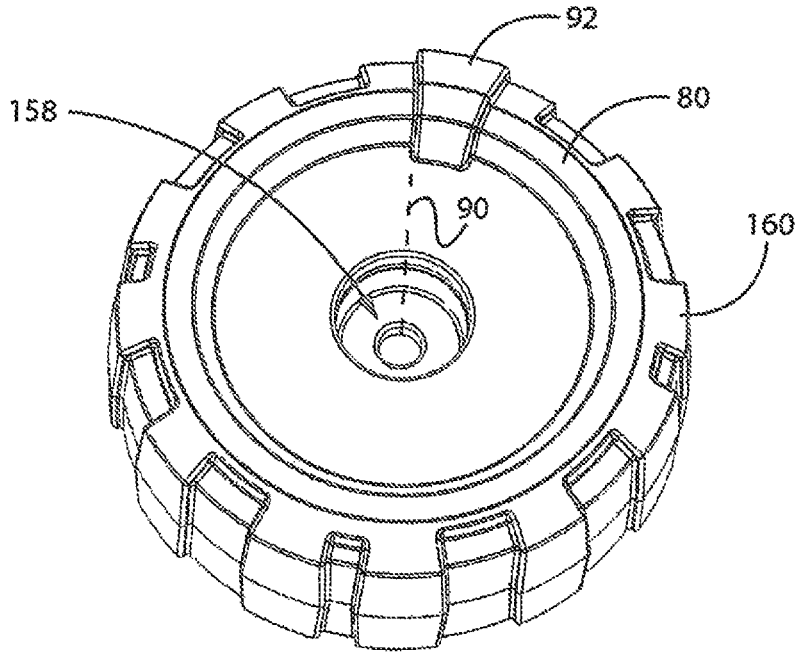
FIG. 7 is an upper perspective view of the dial of the engine control shown in FIG. 6.
Figure 8:
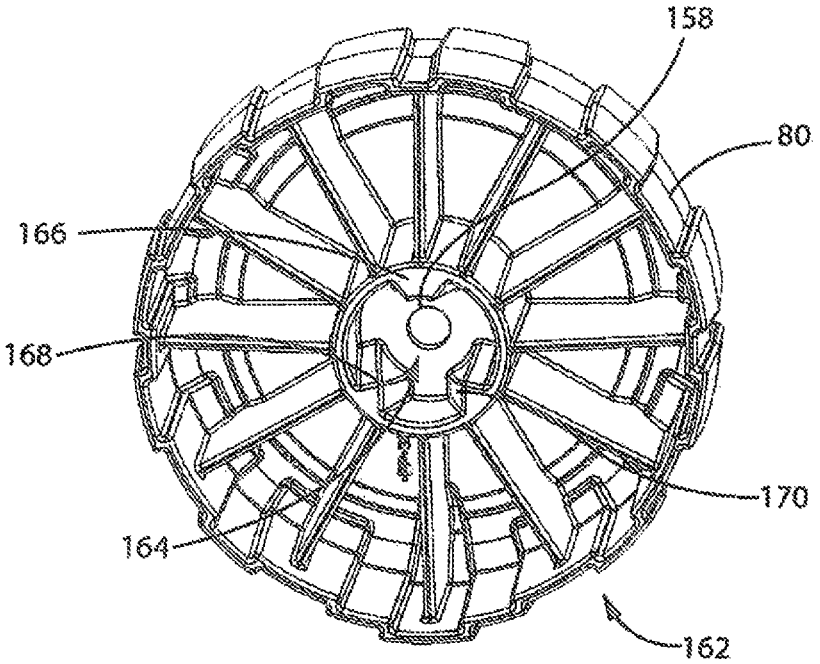
FIG. 8 is a lower perspective view of the dial shown in FIG. 7.

Referring to FIGS. 6-8, dial 80 includes a stepped opening 158 that is shaped for cooperation with fastener 138 and dust cap 140. Indicator 92 is disposed or formed near outward radial edge 160 of dial 80. Outward radial edge 160 is contoured to provide robust interaction with the grip of a user when a hand is associated therewith. As shown in FIG. 8, an underside 162 of dial 80 includes a cavity 164 that is generally aligned with opening 158. Cavity 164 includes a number of inwardly directed radial ribs 166, 168, 170. As explained further below, radial ribs 166, 168, 170 are oriented and shaped to slidably cooperate with an upward facing end 171 (FIG. 11) of barrel 126 such that, when connected, rotation of dial 80 results in a commensurate degree of rotation of barrel 126. Ribs 166, 168, 170 are shaped and oriented to allow only one orientation wherein dial 80 can be secured to barrel 126. Such a consideration ensures that dial 80 is appropriately oriented relative to barrel 126, and thereby control assembly 42, to effectuate the desired operation of control assembly 42 and the desired orientation of indicator 92 of dial 80 relative to indicia 94 associated with dashboard 76 (FIG. 2) and the operation of device 40 associated therewith.

Figure 9:
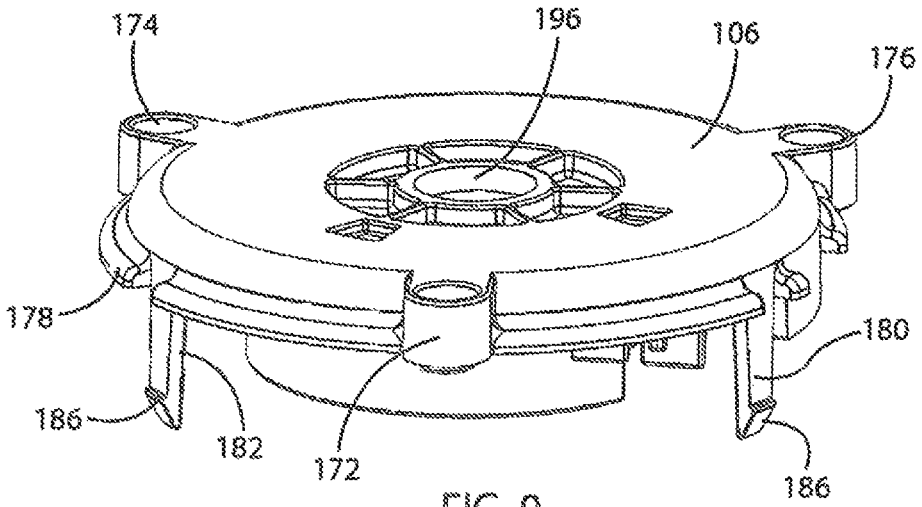
FIG. 9 is an upper perspective view of the cover of the engine control shown in FIG. 6.
Figure 10:
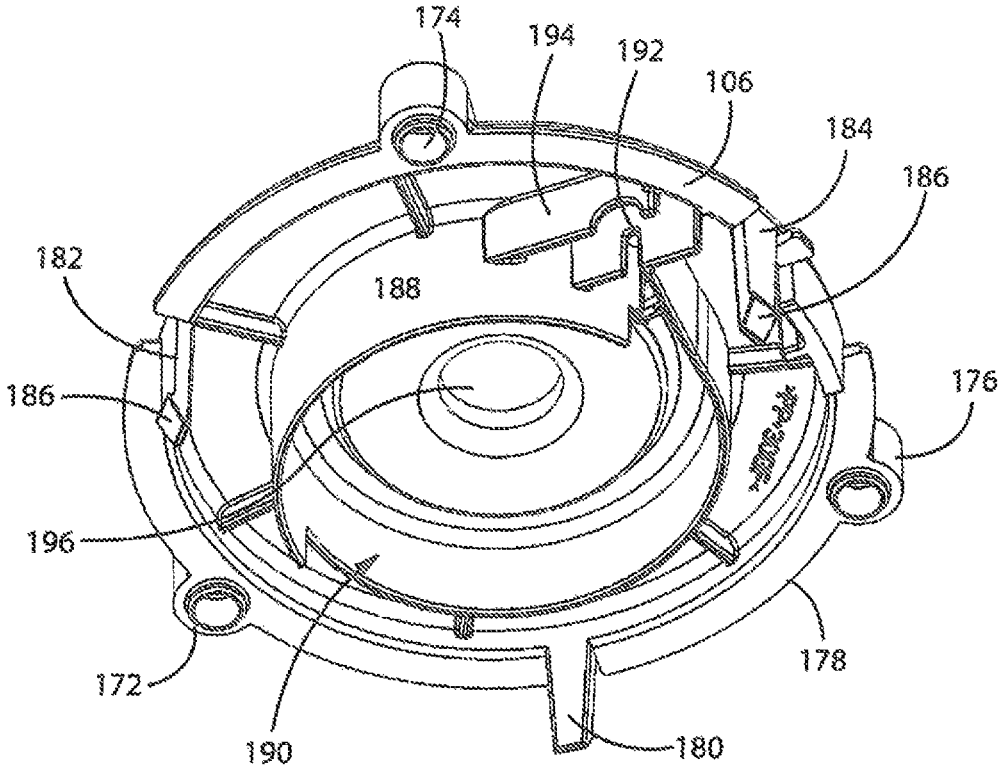
FIG. 10 is a lower perspective view of the cover shown in FIG. 9.

FIGS. 9 and 10 show various different views of cover 106 of control assembly 42. Cover 106 includes one or more bosses 172, 174, 176 that are preferably positioned about a circumferential edge 178 of cover 106. Bosses 172, 174, 176 are oriented to secure control assembly 42 relative to device 40 and/or dashboard 76. One or more tangs 180, 182, 184 extended in a generally axial direction relative to circumferential edge 178. Each tang 180 182, 184 can be deflected in an inward radial direction relative to edge 178 and includes a barb 186 formed at a distal end thereof. As explained further below, tangs 180, 182, 184 are shaped and oriented to allow cover 106 to snap-fittingly cooperate with base 108. Cover 106 includes an upstanding wall 188 that extends in an axial direction relative to circumferential edge 178 to define a cavity 190. A passage 192 is in fluid communication with cavity 190 and associated with a stop 194 such that passage 192 and stop 194 are oriented and shaped to accommodate a secured passage of choke cable 72 beyond circumferential edge 178 of cover 106. An opening 196 is provided through a radial center of cover 106 and is shaped to slidably cooperate with stem 136 of barrel 126 as alluded to above.

Figure 11:
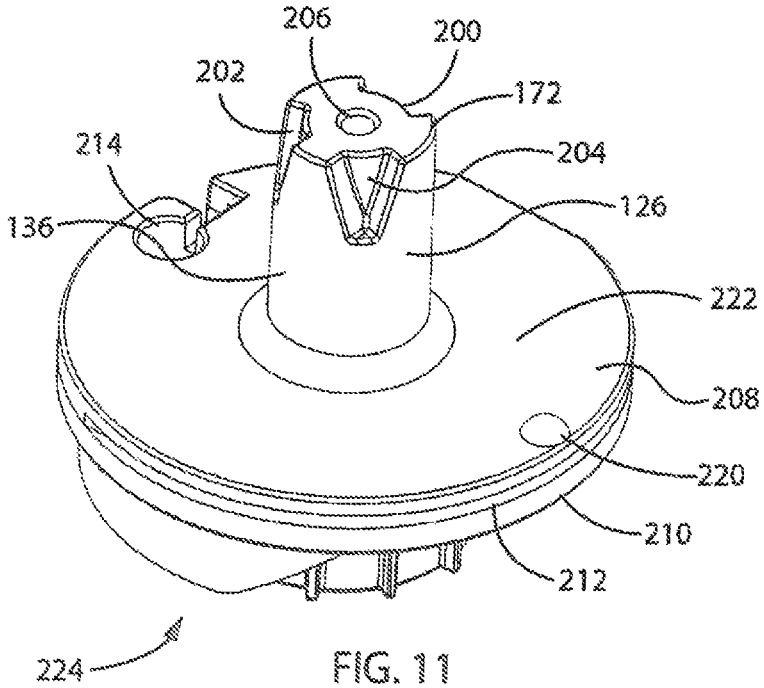
FIG. 11 is an upper perspective view of the barrel of the engine control shown in FIG. 6.

FIGS. 11 through 14 show various views of barrel 126. As shown in FIG. 11 and alluded to above, end 172 of stem portion 136 of barrel 126 includes a number of recesses 200, 202, 204 that are each constructed to receive a respective one of ribs 166, 168, 170 associated with cavity 164 formed in the underside of dial 80 (FIG. 8). A centrally positioned cavity 206 is formed in end 172 of stem portion 136 and shaped to cooperate with fastener 138 for securing dial 80 to barrel 126. As disclosed above, the construction and orientation of a ribs 166, 168, 170 associated with dial 80 and recesses 200, 202, 204 are such that dial 80 can only be secured to barrel 126 in a singular rotational orientation. The keyed cooperation between dial 80 and barrel 126 also ensures that barrel 126 rotates concurrently with rotation of dial 80.

Figure 23:
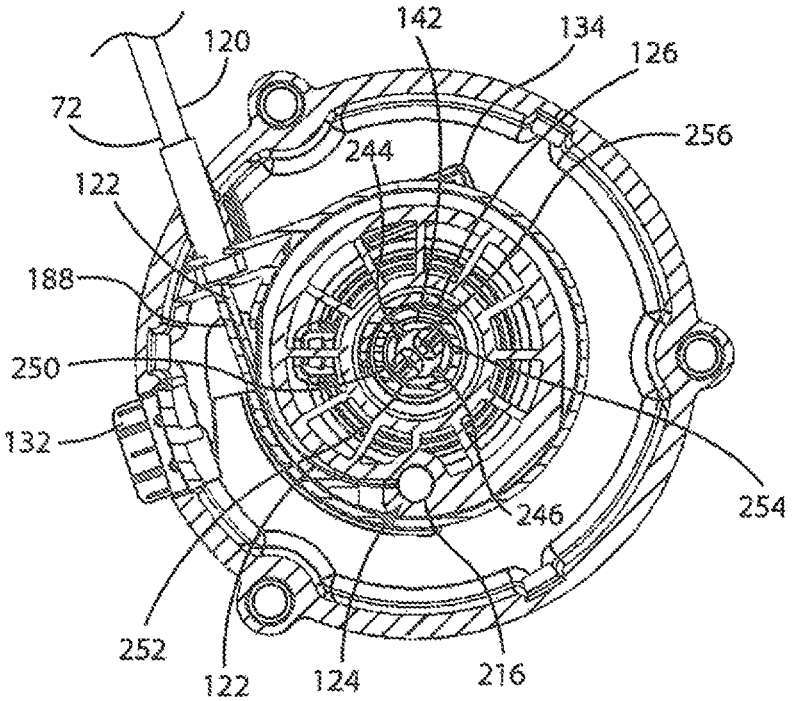
FIG. 23 is a cross-section plan view of the engine control shown in FIG. 5 taken along line 23-23 shown in FIG. 21.

Barrel 126 includes a disk portion 208 that defines an outer circumferential edge 210 of barrel 126. A chase or groove 212 is formed in edge 210 of barrel 126 and is fluidly connected to a pocket 214 formed in disk portion 208 of barrel 126. Pocket 214 is shaped to cooperate with a barrel 216 (FIG. 23) formed at first end 124 of elongate connector 122 of choke cable 72. As explained farther below with respect to FIG. 23, rotation of barrel 126 manipulates the position of elongate connector 122 relative to sheath 120 thereby manipulating the relative position of choke assembly 130, and the choke plate associated therewith, relative to throttle assembly 56. Referring briefly to FIGS. 10 and 11, circumferential edge 210 is shaped and sized to slidably cooperate with wall 188 of cover 106 in close proximity thereto such that portions of elongate connector 122 disposed in groove 212 cannot escape groove 212 when barrel 126 achieves the various rotational and axial positions relative to cover 106. Referring back to FIGS. 11-14, a projection 220 extends in an upward axial direction relative to a top surface 222 of disk portion 208 proximate circumferential edge 210. Projection 220 cooperates with the underside of cover 106 to provide a tactile indication as to the rotational position of control assembly 42.

A downward facing surface 224 of barrel 126 includes a center portion or projection 226, a first radially outward oriented projection or a tab 228, and a second radially outward oriented and downward extending projection or a ramp 230. Tab 228 extends beyond circumferential edge 210 whereas ramp 230 is within a horizontal footprint thereof. Tab 228 and ramp 230 are shown as being radially offset from one another relative to circumferential edge 210 but it is appreciated that other configurations could be provided which satisfy the operational functions associated with tab 228 and ramp 230. As explained further below with respect to FIG. 22, tab 228 is shaped to cooperate with stop switch 132 when dial 80 and barrel 126 are in the stop rotational position 96 (FIG. 2) whereas ramp 230 is shaped and oriented to selectively engage or activate starter circuit switch 134 when dial 80 and barrel 126 are rotated or rotationally offset from stop rotational position 96 and dial 80, and barrel 126 being secured thereto, are displaced or depressed to a downward axial direction associated with the axis of rotation 90 of dial 80 relative to dashboard 76 and/or cover 106 to activate an electric start switch when device 40 is so equipped. That is, it is appreciated that ramp 230 can activate switch 134 during full choke conditions associated with cold start rotational position 98 as well as any run rotational orientations or positions 100 of dial 80. As explained to below, in a preferred embodiment, dial 80 cannot be depressed to interact with start switch 134 when control assembly is in stop rotational position 96. Such a construction allows activation of electric starter devices during full choke conditions, such as commonly associated with a cold start procedure, or partial or non-choke conditions, such as starting of engine 44 when starting of engine 44 does not require a full choke condition.

Figure 12:
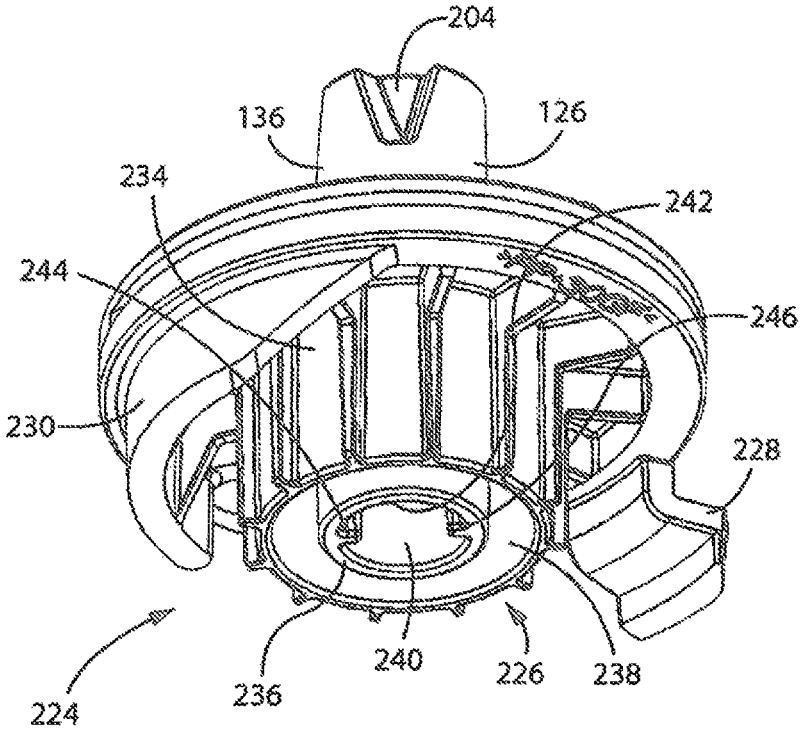
FIG. 12 is a lower perspective view of the barrel shown in FIG. 11.
Figure 13:
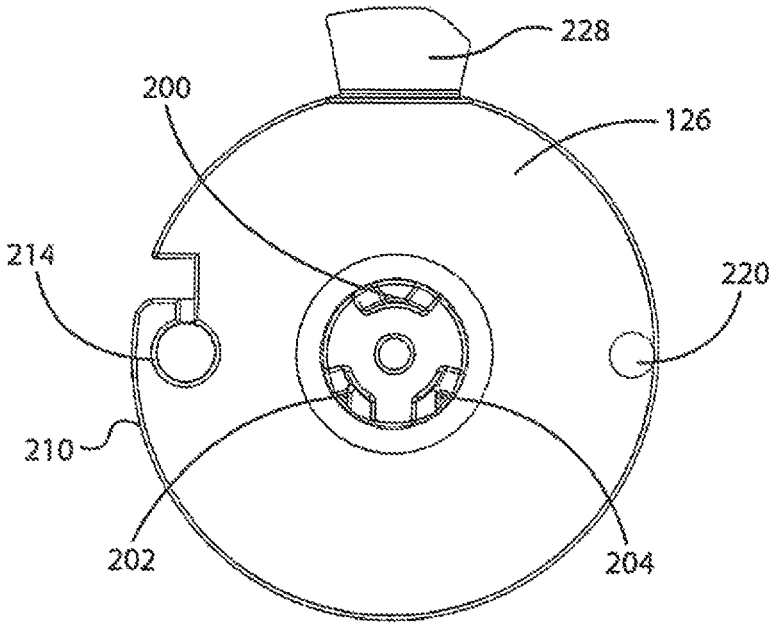
FIG. 13 is a top plan view of the barrel shown in FIG. 11.
Figure 14:
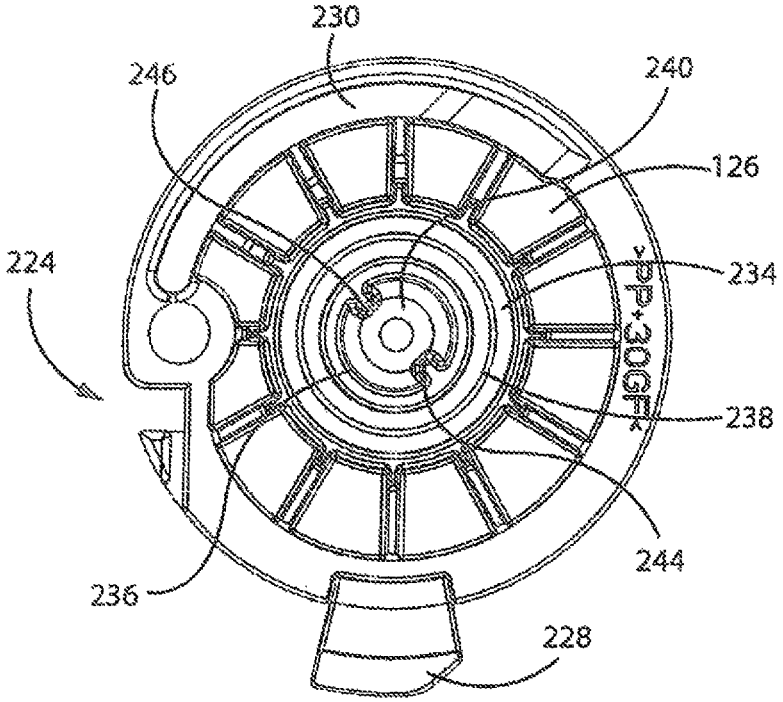
FIG. 14 is a bottom plan view of the barrel shown in FIG. 11.

Referring to FIGS. 12 and 14, center projection 226 of barrel 126 includes a first axially extending wall 234, a second axially extending wall 236, and a cavity 238 defined therebetween. Cavity 238 is shaped to slidably receive spring 154. A center cavity 240 is defined by a radially inward facing surface 242 associated with second axially extending wall 236. Cavity 240 is shaped to slidably receive second portion 146 of extender 142. Surface 242 includes one or more tabs or ridges 244, 246 that extend in an inward radial direction relative to wall 236. As disclosed further below, ridges 244, 246 cooperate with the shape of second portion 146 of extender 142 such that, during rotation of barrel 126, ridges 244, 246 rotationally interfere with second portion 146 of extender 142 without interfering with the slidable axial interaction therebetween as disclosed above. Ridges 244, 246 slidably cooperate with a respective groove that is generally defined by outward radially oriented projections associated with second portion 146 of extender 142. Ridges 244, 246 of barrel 126 cooperate with extender 142 such that user rotation of barrel 126 rotates extender 142.

Figure 15:
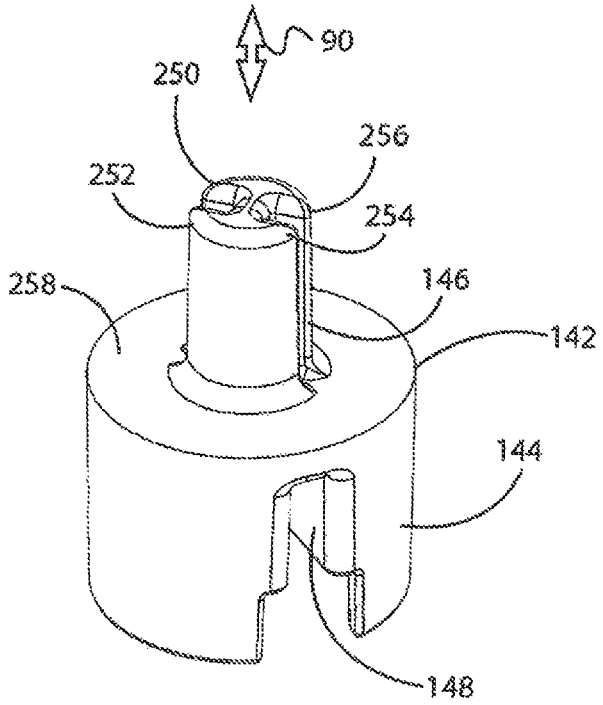
FIG. 15 is an upper perspective view of the extender of the engine control shown in FIG. 6.
Figure 16:
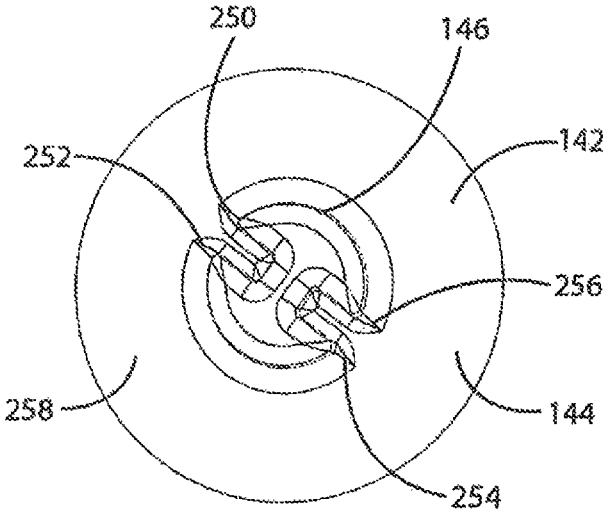
FIG. 16 is a top plan view of the extender shown in FIG. 15.
Figure 17:
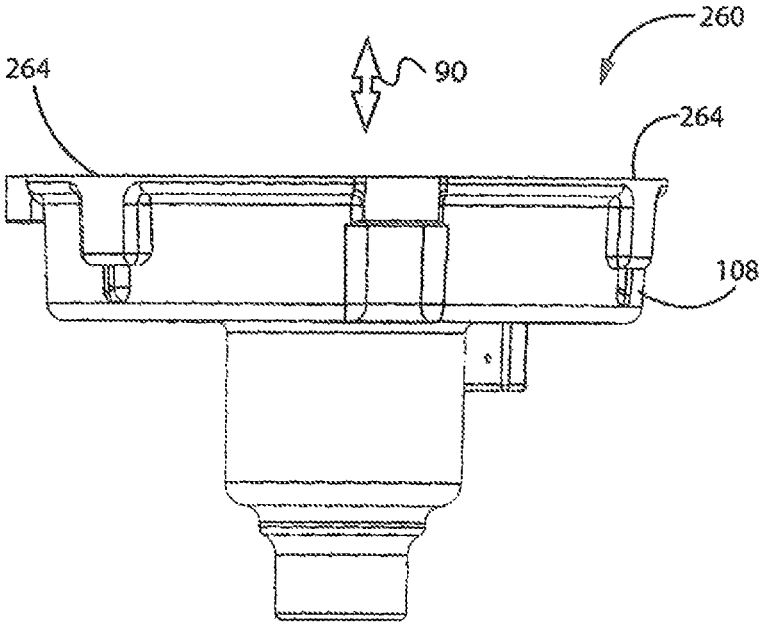
FIG. 17 is a side elevation view of the base of the engine control shown in FIG. 6.
Figure 18:
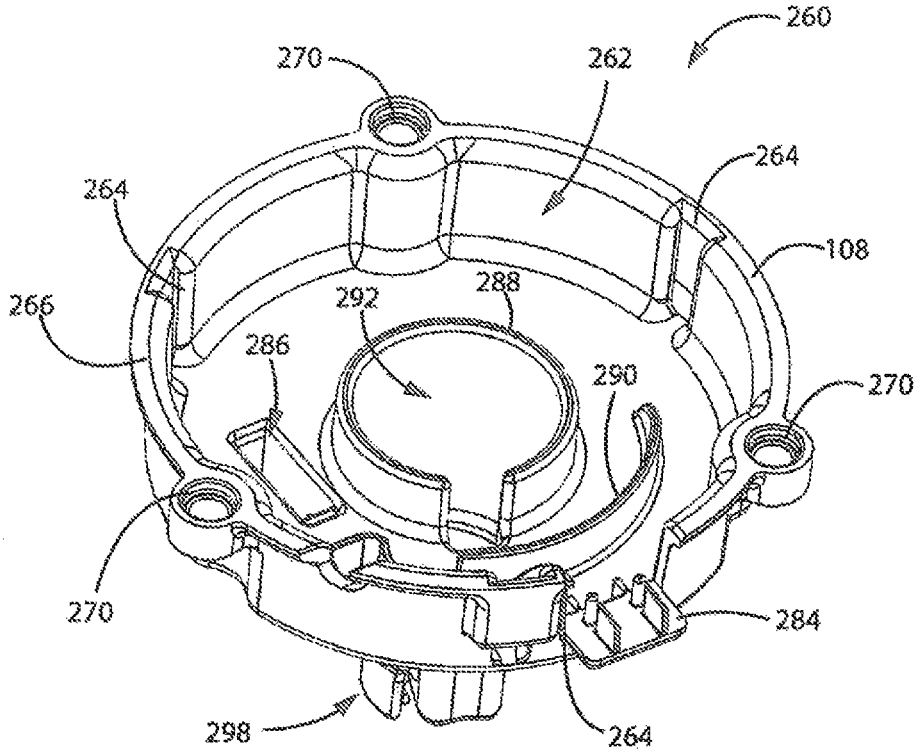
FIG. 18 is an upper perspective view of the base shown in FIG. 17.
Figure 19:
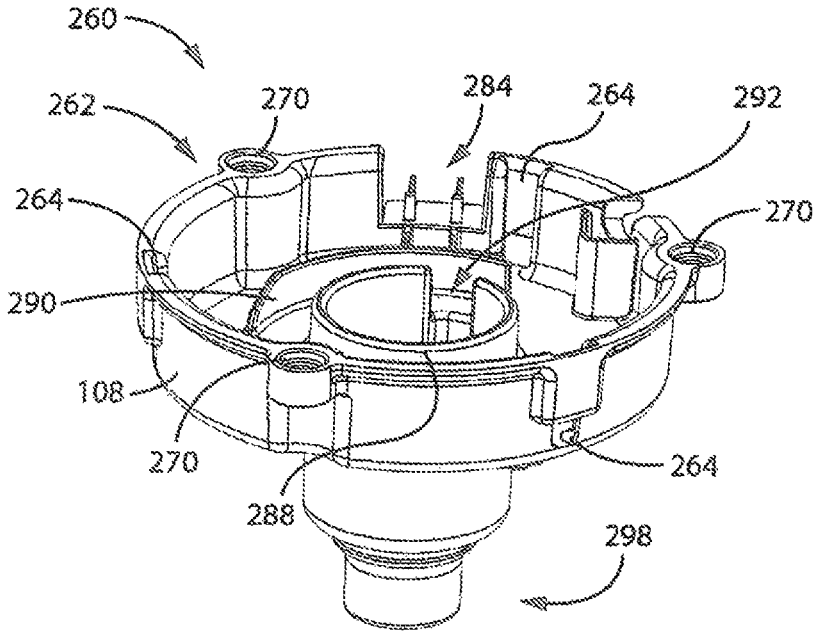
FIG. 19 is an upper perspective view of the base from a vantage opposite the base shown in FIG. 18.
Figure 20:
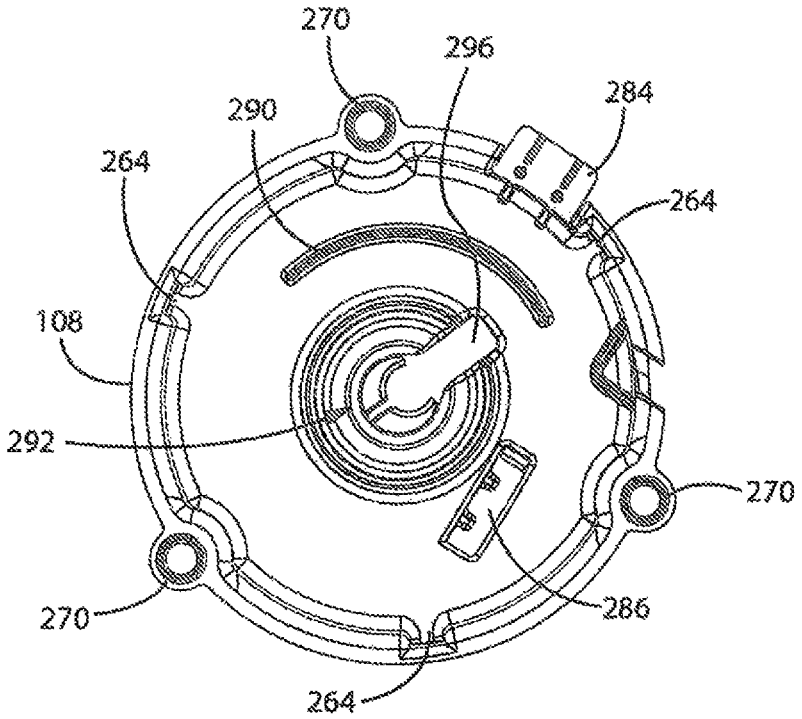
FIG. 20 is a top plan view of the base shown in FIG. 17.

Referring to FIGS. 15 and 16, second portion 146 of extender 142 includes one or more ridges or projections 250, 252, 254, 256 that extend in a generally outward radial direction relative to axis 90 to define the grooves formed between each respective pair 250, 252 and 254, 256 of ridges. Preferably, projections 250 252, 254, 256 extend in a longitudinal direction along a substantial portion of the longitudinal length of second portion 146 of extender 142. As alluded to above and is disclosed further below, projections 250, 252, 254, 256 associated with extender 142 interact with projections 244, 246 (FIG. 14) of barrel 126 to facilitate an equal degree of rotation of extender 142 relative to the relative degree of rotation of barrel 126 for the range of rotation of barrel 126 relative to cover 106.

Still referring to FIGS. 15-16, extender 142 includes in upward directed surface 258 defined generally between first portion 144 and second portion 146 of extender 142. Surface 258 is shaped to cooperate with a respective end of spring 154 (FIG. 6) such that second portion 146 of extender 142 slidably cooperates with cavity 240 defined by barrel 126. Spring 154 biases extender 142 and barrel 126 in opposite axial directions 90 such that slot 148 of extender 142 is biased into engagement with handle 150 (FIG. 6) of fuel valve assembly 112. The slidable interaction between barrel 126 and extender 142 does not interfere with the relative rotational interaction therebetween.

Slot 148 associated with first portion 144 of extender 142 is shaped such that any rotation of extender 142 rotates handle 150 of fuel valve assembly 112. It is appreciated however that slot 148 and/or the operational association of projections 244, 246 of barrel 126 with projections 250, 252, 254, 256 of extender 142 could be shaped to allow relative rotation between extender 142 and handle 150 of fuel valve assembly 112 in accordance with the operational construction associated with fuel valve assembly 112. Such consideration allows utilization of fuel valve assemblies 112 having different degrees of rotation of handle 150 relative to the underlying fuel valve assembly 112 to effectuate fully closed or fully open orientations of the fuel valve assembly. One such alternative is shown and disclosed below with respect to FIGS. 27-30. Although shown therein as accommodating a selective rotational cooperation between the barrel and the extender, it is appreciated that the rotational cooperation between barrel 126 and extender 142 and/or the rotational cooperation between slot 148 and handle 150 of fuel valve assembly 112 can be configured to allow utilization of fuel valve assemblies wherein handle 150 is rotatable 180°, 90°, or other radial orientations to effectuate the fully open or fully closed orientations of fuel valve assembly 112. That which is shown in FIGS. 27-30 is an example of just one such configuration within the scope of the appending claims and it is recognized that other configurations may provide similar selective rotational cooperation associated with manipulation the dial and the rotational effect associated with the manipulation of the handle of the fuel valve associated the resultant control assembly.

FIGS. 17-20 show various views of base 108 of control assembly 42. An upward facing end 260 of base 108 defines a cavity 262 shaped to accommodate the rotational cooperation of barrel 126 and extender 142 relative thereto. A plurality of slots 264 are formed in a circumferential wall 266 that extends about cavity 262. Slots 264 extend in generally axial direction and are shaped to slidably cooperate with tangs 180, 182, 184 of cover 106 (FIG. 10) and snap fittingly cooperate with the respective barbs 186 associated therewith such that cover 106 snap fittingly cooperates with base 108. Base 108 includes a number of bosses 270 that are shaped to be aligned with the respective boss 172, 174, 176 associated with cover 106 and facilitate passage of a connector or other fasteners therethrough for securing control assembly 42 relative to device 40. The cooperation of tangs 180, 182, 184, respective slots 264, and respective bosses 172, 174, 176, 270 accommodate assembly of control assembly 42 and subsequent connection or mounting of control assembly 42 relative to device 40.

Base 108 includes a first pocket 284 that is shaped to cooperate with stop switch 132 (FIG. 5) and a second pocket 286 that is shaped to cooperate with start switch 134 (FIG. 5). Although various orientations are envisioned, pocket 284 is preferably oriented in circumferential wall 266 of base 108 whereas pocket 286 is offset in an inward radial direction relative thereto. Base 108 includes a first upstanding wall 288 that extends in generally axial direction 90 at a position radially inboard of circumferential wall 266 and a second upstanding wall 290 that also extends in axial direction 90 and at a radial location between walls 266, 288. Second upstanding wall 290 is preferably circumferentially aligned with stop switch pocket 284 for reasons further described below. It is appreciated however that second upstanding wall 290 could be provided at other locations.

Base 108 includes an opening or passage 292 that is positioned radially inboard of first upstanding wall 288. Passage 292 has a generally circular shape with a cutout 296 associated therewith. Passage 292 and cutout 296 are shaped to accommodate the axial translation of fuel valve assembly 112 relative to base 108 during assembly of control assembly 42. That is, cutout 296 is shaped to accommodate the slidable translation of barb 118 (FIG. 6) associated with fuel valve assembly 112 such that both barbs 116, 118 of fuel valve assembly 112 extend beyond lower end 114 of base 108 when fuel valve assembly 112 is associated therewith. Preferably, fuel valve assembly 112 snap-fitting cooperates with base 108. It is further envisioned that the interaction therebetween be selectively severable to allow removal or replace of fuel valve assembly 112 should the need arise.

Figure 21:
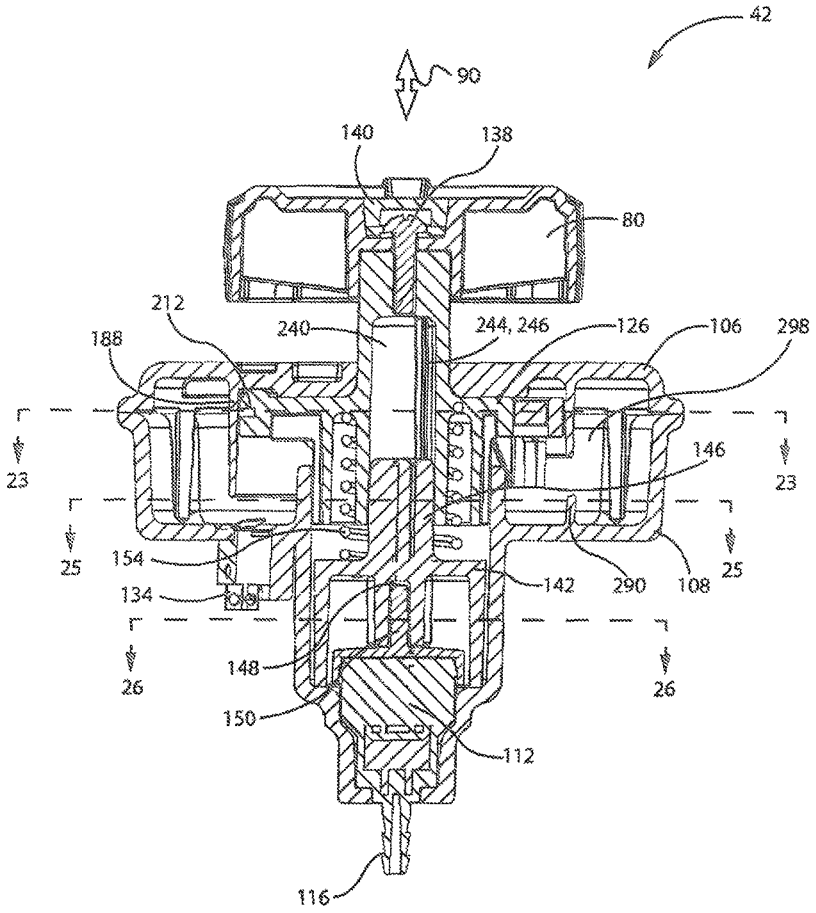
FIG. 21 is a vertical cross-section view of the engine control shown in FIG. 5.
Figure 25:
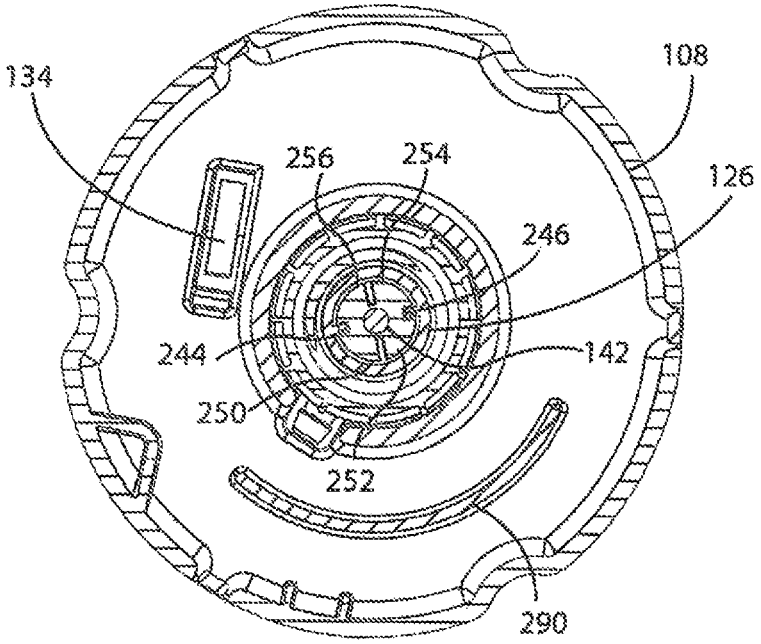
FIG. 25 is a cross-section plan view of the engine control shown in FIG. 5 taken along line 25-25 shown in FIG. 21.
Figure 26:
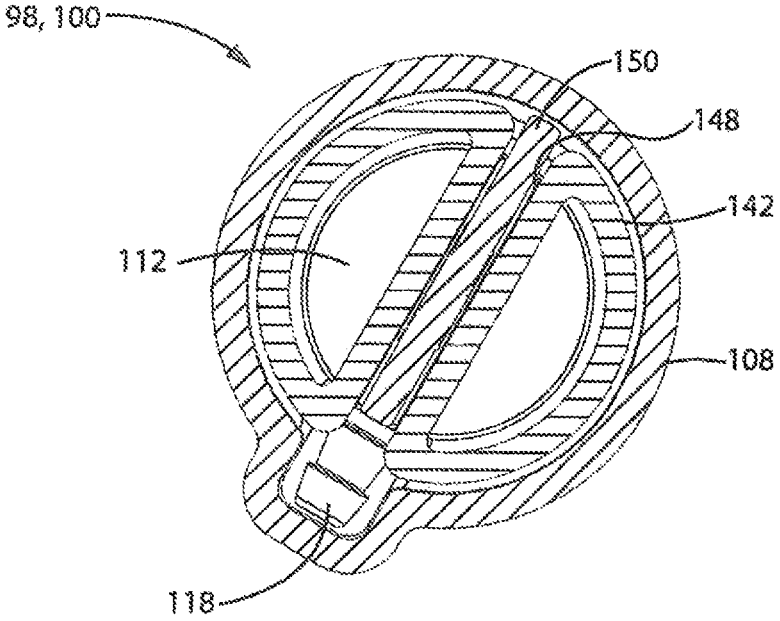
FIG. 26 is a cross-section plan view of the engine control shown in FIG. 5 taken along line 26-26 shown in FIG. 21.

FIG. 21 is in axial cross-section view of control assembly 42. As disclosed above, dial 80 is positionally fixed with respect to barrel 126. Barrel 126 rotationally and axially cooperates with a cavity 298 defined between cover 106 and base 108. Slot 148 of extender 142 operationally engages handle 150 of fuel valve assembly 112 such that rotation of handle 150 manipulates the OPEN or CLOSED configuration associated with fuel valve assembly 112. Second portion 146 of extender 142 is slidably disposed in cavity 240 of barrel 126. Spring 154 concurrently biases barrel 126 in an upward axial direction 90 into engagement with an underside of cover 106 and extender 142 in a downward axial direction into engagement with handle 150 of fuel valve assembly 112. As disclosed further below with respect to FIGS. 23 and 25, the axial or longitudinal interface between barrel 126 and second portion 146 of extender 142 provides a direct rotational cooperation between barrel 126, extender 142, and handle 150 of fuel valve assembly 112.

Figure 22:
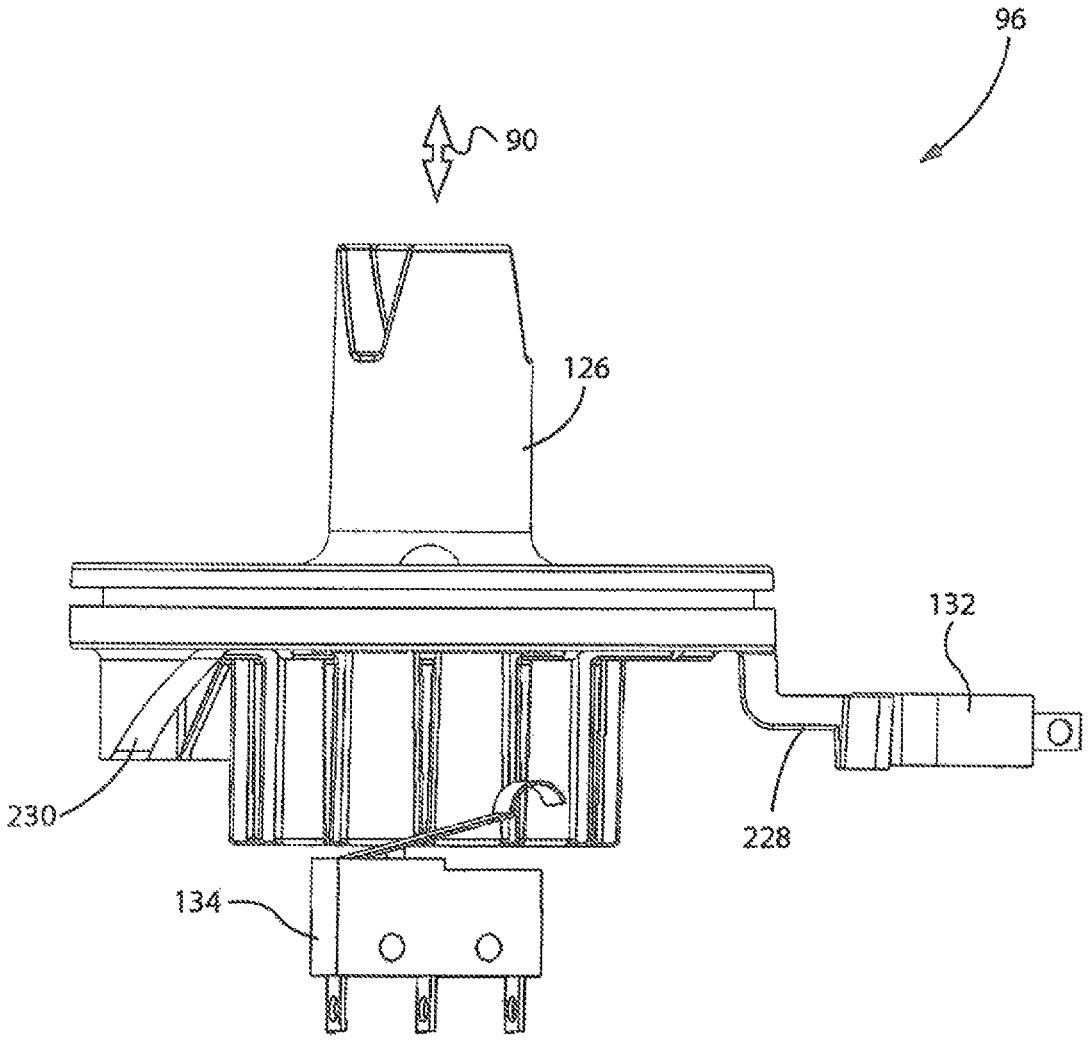
FIG. 22 is an elevation view of the barrel shown in FIG. 6 associated with an engine shut-off switch and a starter activation switch.

Referring to FIG. 22, when barrel 126 is in stop rotational position 96, tab 228 of barrel 126 cooperates with stop switch 132 thereby grounding, shunting or otherwise disabling operation of the ignition circuit associated with operation of engine 44. Rotation of barrel 126 in a counterclockwise direction rotates tab 228 out of engagement with stop switch 132 thereby allowing completion of the ignition circuit to accommodate subsequent starting and/or continued operation of engine 44. Rotation of barrel 126 from stop rotational position 96 allows rotational alignment of ramp 230 of barrel 126 with optional engine start switch 134. Depressing dial 80 translates barrel 126 in a downward axial direction 90 such that wall 230 interferes with start switch 134 to effectuate electronic starting of devices so equipped. Preferably, wall 230 can interact with start switch 134 when barrel 126 is at any radial position wherein tab 228 is not aligned or otherwise rotationally offset from stop switch 132. Preferably, barrel 126 or tab 228 cooperate with wall 290 of base 108 in close axial proximity relative to one another such that interference between tab 228 and wall 290 of base 108 prevents depressing of dial 80, and thereby axial translation of barrel 126, when the engine ignition circuit is disabled with interaction of tab 228 with stop switch 132. Such a configuration provides a tactile indication to the user that the ignition and fuel valve assemblies are in the OFF configuration such that operation of engine 44 is not possible when dial 80 is in stop rotational position 96. Such a consideration also prevents unnecessary operation of starters when the fuel and ignition systems are not configured for operation of engine 44.

Referring to FIGS. 2-4 and 23-26, as understood from the disclosure above, when dial 80 is in stop rotational position 96, the engine ignition system is disabled via interaction between tab 228 and stop switch 132, throttle assembly 56 has a choke full open condition, and fuel valve assembly 112 is in a fuel OFF condition. Rotation of dial 80 in a counterclockwise direction from stop rotational position 96 toward cold start rotational position 98 enables operation of the ignition circuit associated with operation of engine 44 and also rotates barrel 126 thereby manipulating the orientation of elongate connector 122 of choke cable 72, and thereby the position of a choke plate relative to the throttle assembly 56. It should be appreciated that the incremental rotation of barrel 126 achieves incremental rotational positions of the choke plate relative to throttle assembly 56 until the cold start rotational position 98 is achieved.

The rotational interference between projections 244, 246 associated with barrel 126 and projections 250, 252, 254, 256 of extender 142 also facilitates rotation of handle 150 of fuel valve assembly 112 as dial 80 is rotated away from the stop rotational position thereby opening fuel valve assembly 112. Fuel valve assembly 112 preferably achieves a fully OPEN configuration at rotational locations of dial 80 that are offset from the stop rotational position and preferably at any rotational positions between the steady state operating rotational position and the cold-start rotational position associated with the rotation position of dial 80. That is, it should be appreciated that the full OPEN orientation of fuel valve assembly 112 is achieved at rotational position achieved before barrel 126 achieves the cold start rotational position. Preferably, when barrel 126 is rotated toward cold start rotational position 98, barrel 126 rotationally interferes with extender 142 to rotate handle 150 of fuel valve assembly 112 from the CLOSED of fuel OFF orientation associated with stop rotational position 96, to a fully open or fuel ON condition necessary for operation of engine 44 when control assembly 42 achieves cold start rotational position 98 and any of the run rotational positions 100 between the cold start rotational position and a steady state/no choke rotational position. As alluded to above, is appreciated that fuel valve assembly 112 can be constructed to be operable from fully closed or fuel OFF to fully open or fuel ON orientations with various relative degrees of rotation of handle 150. That is, it is envisioned that fuel valve assembly 112 can be constructed to achieve fully open configurations when handle 150 is rotated 180°, 90°, or other degrees of relative rotation of handle 150 relative to the orientation of handle 150 when fuel valve assembly is in the fuel OFF orientation associated with the stop rotational position 96. Regardless of the rotational operation associated with the manipulation of the fuel, valve assembly, it should be appreciated that when control assembly 42 is oriented in stop rotational position 96, fuel valve assembly 112 is closed or achieves a fuel OFF condition and fuel valve assembly 112 can achieve open or fuel ON conditions when handle 150 achieves rotational positions offset from the orientation associated with the stop rotational position 96.

In a preferred embodiment, stop rotational position 96 is associated with a closed fuel valve assembly 112, a fully open choke condition associated with throttle assembly 56, and disabled operation of electronic start functionality associated with start switch 134. Counterclockwise rotation of dial 80 to cold start rotational position 98 is associated with a fully open condition of fuel valve assembly 112, a fully closed choke plate condition associated with throttle assembly 56, and selective operability of an electronic ignition system associated with start switch 134 via axial displacement or pressing of dial 80. Clockwise rotation of dial 80 from cold start rotational position 98 toward run rotational positions 100 incrementally manipulates the orientation or configuration of the choke associated with throttle assembly 56, does not interfere with the open configuration associated with fuel valve assembly 111 and maintains the selective operability of the electronic starting system associated with electronic start switch 134.

The selective actuation of start switch 134 as well as the open condition of fuel valve assembly 112 at rotational positions offset from stop rotational position 96 allows subsequent starting of engine 44 after engine 44 has achieved an operating condition or temperature that does not require a full choke condition for starting of engine without rotation of dial 80 to cold start rotational position 98. For example, if device 40 has be operated for an extended period of time so as to achieve at least a near desired or run operating temperature, should the user elect to suspend operation of the device, the user need simply rotate dial 80 to stop rotational position 96. Such action closes the fuel valve assembly 112 and interrupts the ignition circuit thereby terminating engine operation in a customary manner. After interruptions that do not achieve engine cold conditions, the user need simply rotate dial 80 in a counterclockwise direction from the stop rotational position 96 to complete the ignition circuit and open the fuel valve and subsequent interact with the starting device 50, via pulling of handle 52 of a recoil or depressing dial 80, to effectuate subsequent starting of engine 44.

When dial 80 is oriented at rotational positions between stop rotational position 96 and cold start rotational position 98, the ignition system, choke, and fuel valve assemblies are oriented to support self sustained operation of engine 44 as well as selective operation of an electric engine start system. Preferably, steady state self sustained operation of engine 44 is associated with a full open choke configuration of throttle assembly 56 and a full open configuration of fuel valve assembly 112.

When it is desired to stop engine 44, clockwise rotation of dial 80 toward stop rotational position 96 gradually closes fuel valve assembly 112, disables axial displacement of dial 80 to prevent operation of an electronic starter when the device is so equipped, and ultimately actuate engine stop switch 132 thereby terminating operation of engine 44 via suspension of communication of the ignition signal to the spark plug effectively stopping the engine in a manner that allows subsequent operation of device 40 in accordance with the starting and operational sequence disclosed above. Accordingly, engine control assembly 42 provides a single input assembly that allows the user to control the ON/OFF functionality of a fuel valve assembly, control the engine choke, and ignition system configuration to start, stop, and maintain steady state operation of engine 44 via interaction with the single control assembly 42. Control assembly 42 is also preferably constructed to allow user interaction and operation of an engine electric starter when the underlying device is so equipped. As such, the configuration allows even inexperienced operators or user to expeditiously start, stop, and maintain operation of engine 44 of device 40.

FIGS. 27-30 show various views of an alternate barrel 300 and extender 302 usable with control assembly 42 according to another embodiment of the present invention. When equipped with barrel 300 and extender 302, control assembly 42 is operable in a manner similar to that described above to control the fuel flow connectivity, choke, ignition, and starting system control associated with operation of device 40. Specifically, FIGS. 27-30 and the following description thereof disclose an example of providing a selective rotational cooperation as alluded to above between the dial and the fuel valve assembly associated with achieving one or more of the operational objectives disclosed herein.

Barrel 300 and extender 302 are constructed to cooperate with device 40, choke cable 72, dashboard 76, dial 80, cover 106, base 108, fuel valve assembly 112, stop switch 132, and start switch 134 in a manner similar to that disclosed above. Accordingly, only pertinent portions of barrel 300 and extender 302 associated with distinctions between barrel 126 and barrel 300 and extender 142 and extender 302 are discussed further below. Barrel 300 and extender 302 slidably cooperate with one another and are associated with one another such that rotation of barrel 300 results in rotation of extender 302, and the handle of the fuel valve assembly associated therewith, only for a portion of the total range of rotation of barrel 300. As disclosed further below, the portion of the range of rotation of barrel 300 which results in rotation of extender 302 is preferably between other portions of the total range of rotation of barrel 300 wherein rotation of barrel 300 does not manipulate the rotational position of extender 302.

Figure 27:
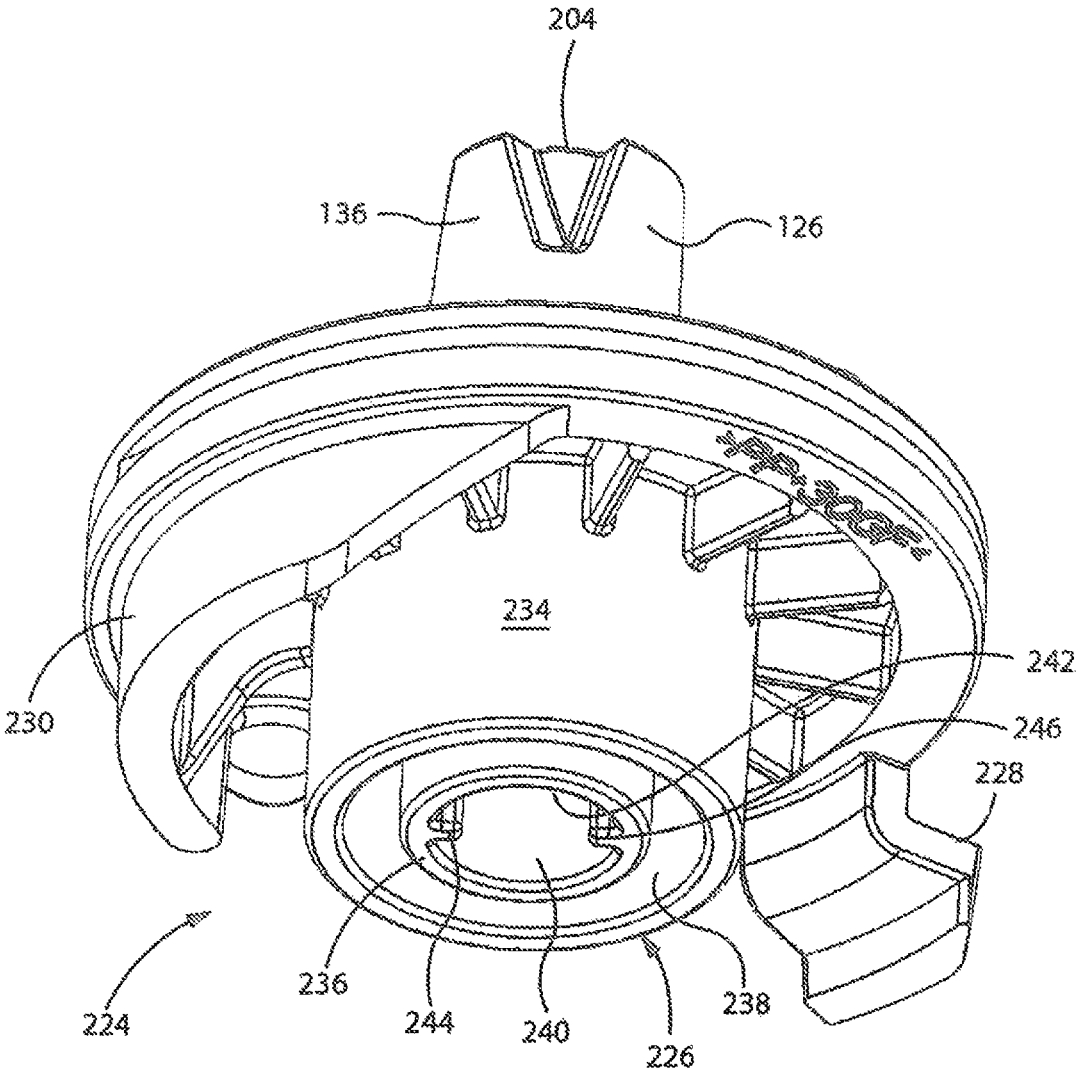
FIG. 27 is a view similar to FIG. 12 of another embodiment of a barrel associated with forming a control system of the engine powered device shown in FIG. 1.

As shown in FIG. 27, barrel 300 includes a downward facing surface 304 that defines a cavity 306 that is shaped to slidably receive a portion of extender 302. A radially inward directed surface associated with cavity 306 includes one or more tabs, projections, or ridges 308, 310 that extend in an inward radial direction relative to a wall 312 that extends about cavity 306. Ridges 308, 310 cooperate with the shape of the portion of extender 302 that is slidably associated therewith such that, during rotation of barrel 300, ridges 308, 310 selectively engage and disengage from rotational interference with extender 302. That is during a first portion of rotation of barrel 300, ridges 308, 310 interfere with outward radially directed projections associated with extender 302 and during a second portion of rotation of barrel 300, ridges 308, 310 rotationally translate relative to extender 302 such that barrel 300 rotates relative to extender 302 and does not otherwise interfere with or manipulate the rotational orientation of extender 302 or a handle of a fuel valve assembly associated therewith.

Figure 28:
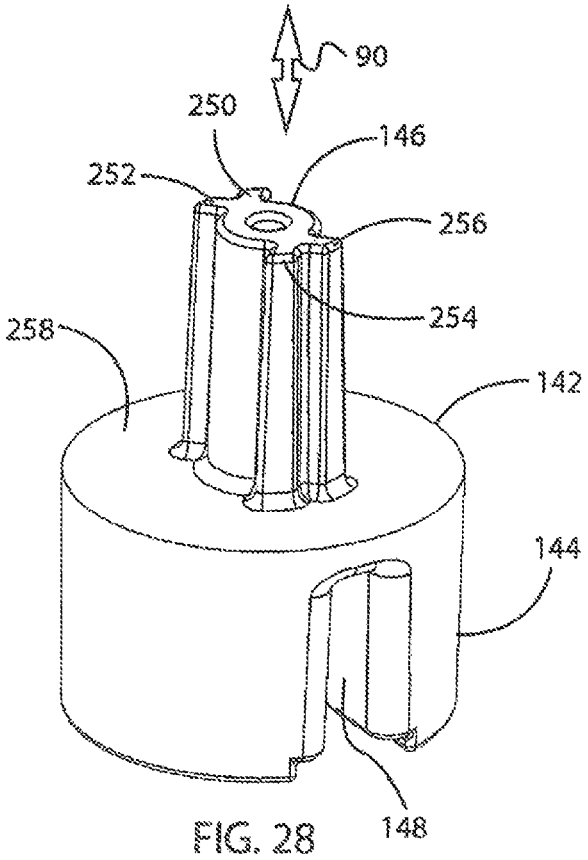
FIG. 28 is a view similar to FIG. 15 of an extender for use with the barrel shown in FIG. 27.
Figure 29:
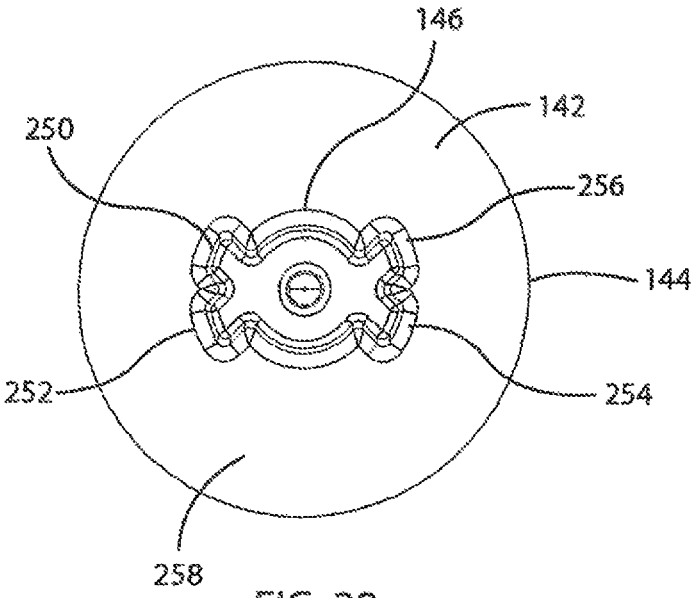
FIG. 29 is a view similar to FIG. 16 of the extender shown in FIG. 28.
Figure 30:
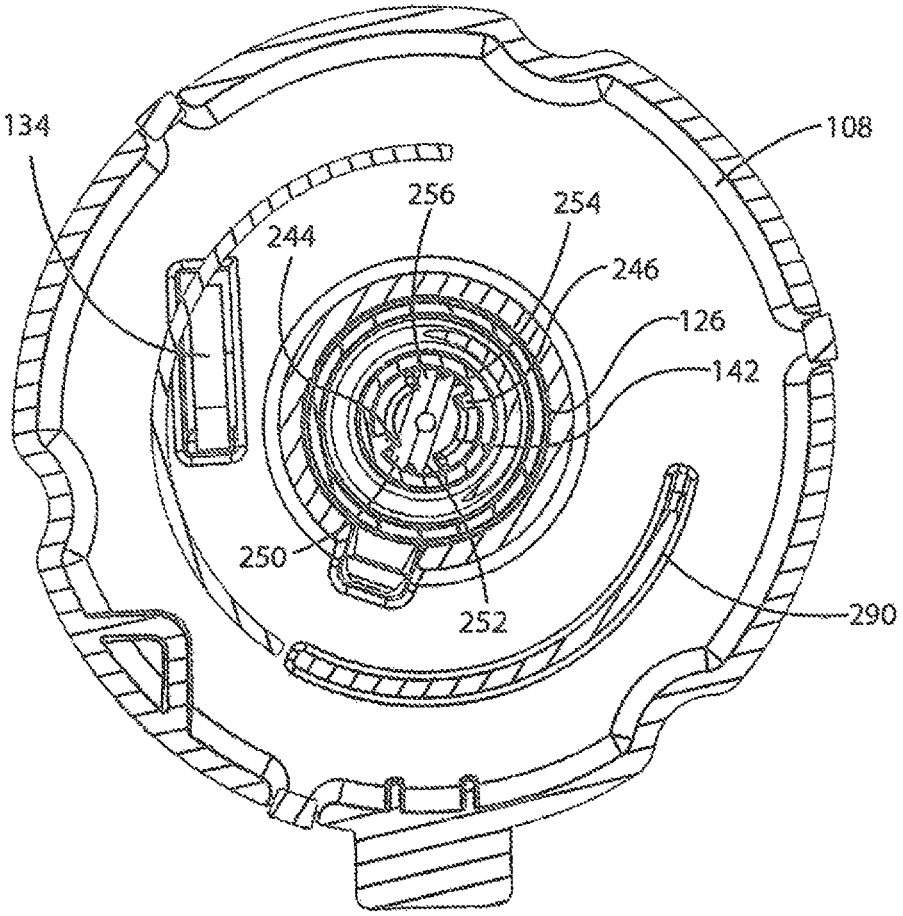
FIG. 30 is a view similar to FIG. 25 and shows a plan cross-section view of the barrel and extender shown in FIGS. 27-29 associated with one another within the control assembly.

Referring to FIGS. 28-30, a barrel facing portion 314 of extender 302, similar to second portion 146 of extender 142, includes one or more projections or ridges 316, 318, 320, 322 that extend in a generally outward radial direction relative to axis 90. Preferably, projections 316, 318, 320, 322 extend in a longitudinal direction along a substantial portion of the longitudinal length of portion 314 of extender 302. As alluded to above and is disclosed further below, projections 316, 318, 320, 322 associated with extender 302 interact with projections 308, 310 (FIG. 27) of barrel 300 to facilitate selective but a none equal degrees of rotation of extender 302 relative to the relative degree of rotation of barrel 300 for selective portions of the range of rotation of barrel 300 associated with user rotation of a dial secured thereto. Preferably, rotation of extender 302 in response to rotation of barrel 300 and the dial associated therewith is provided at opposite ends of the total range of rotation of barrel 300.

Still referring to FIGS. 28-30, extender 302 includes an upward directed surface 324 defined generally between the barrel facing portion 314 and a fuel valve assembly facing portion 326 of extender 302. Surface 324 is shaped to cooperate with a respective end of a spring captured between barrel 300 and barrel facing portion 314 of extender 302 such that portion 314 of extender 302 slidably cooperates with cavity 306 defined by barrel 300. The spring biases extender 302 and barrel 300 in opposite axial directions 90 such that a slot 328 of extender 302 is biased into engagement with a handle of a fuel valve assembly associated therewith. The slidable interaction between barrel 300 and extender 302 does not interfere with the selective rotational interaction therebetween.

Slot 328 associated with valve facing portion 326 of extender 302 is shaped such that any rotation of extender 302 rotates the handle of a fuel valve assembly associated therewith. It is appreciated however that slot 328 and/or the operational association of projections 308, 310 of barrel 300 with projections 316, 318, 320, 322 of extender 302 could be shaped to allow relative rotation between extender 302 and the handle of the fuel valve assembly in accordance with the operational construction associated with fuel valve assembly 112. Such consideration allows utilization of fuel valve assemblies having different degrees of rotation of fuel valve handle relative to the underlying fuel valve assembly to effectuate fully closed or fully open orientations of the fuel valve assembly. That is, the rotational cooperation between barrel 300 and extender 302 and/or the rotational cooperation between slot 328 and the handle of the fuel valve assembly can be configured to allow utilization of fuel valve assemblies wherein handle 150 is rotatable 180°, 90°, or other radial orientations to effectuate the fully open or fully closed orientations of associated with the respective fuel valve assembly.

By comparison, it should be appreciated that the rotational cooperation between barrel 126, extender 142, and handle 150 of fuel valve assembly 112 associated with the arrangement shown in FIGS. 12-26 and control assemblies equipped with barrel 300 and extender 302 are associated with use of fuel valve assemblies that achieve fully open conditions and fully closed positions at different rotational orientations or positions of the handle relative to the remainder of the fuel valve assembly. Such a consideration allows control assembly 42 to be configured for operation of device 40 with fuel valve assemblies having alternate constructions and improves the applicability of control assembly 42.

Many changes and modifications could be made to the invention without departing from the spirit thereof. The scope of these changes will become apparent from the appended claims.

What we claim is:

1. A method of forming a control for operation of a portable engine powered device, the method comprising:

providing a single user input that is rotatable from a first radial position associated with grounding an engine ignition circuit, a closed orientation of a fuel valve, and an open choke condition toward a second radial position associated with closing the engine ignition circuit, opening of the fuel valve, and a closed choke condition for subsequent cold starting of an internal combustion engine;

providing a slidable connection between a first body of the single user input and a several body of the single user input;

connecting a choke cable to the first body; and engaging the second body with the fuel valve.

2. The method of claim 1 further comprising providing a fully open fuel valve condition when the single user input is at least one of between the first radial position and the second radial position or achieves the second radial position.

3. The method of claim 1 further comprising providing a rotational interface between the first body and the second body, the rotational interface having a first portion wherein rotation of the first body rotates the second body and a second portion wherein the first body rotates relative to the second body.

4. The method of claim 3 wherein the second portion of the rotational interface flanks the first portion of the rotational interface.

5. The method of claim 1 further comprising orienting a switch associated with grounding the engine ignition circuit in operative association with a tab formed by the first body.

6. The method of claim 1 further comprising fluidly connecting a fossil fuel source to the fuel valve.

7. The method of claim 6 wherein the fossil fuel source is further defined as a liquid propane tank.

8. A method of forming a control for operation of a portable engine powered device, the method comprising:

providing a single user input that is rotatable from a first radial position associated with grounding an engine ignition circuit, a closed orientation of a fuel valve, and an open choke condition toward a second radial position, associated with closing the engine ignition circuit, opening of the fuel valve, and a closed choke condition for subsequent cold starting of an internal combustion engine;

providing a slidable connection between a first body of the single user input and a second body of the single user input; and orienting a switch, associated with operation of a starter for electronic starting of the internal combustion engine, to interact with the first body when the first body is axially displaced relative to the second body.

9. The method of claim 8 further comprising constructing the first body to interact with the switch when the first body is rotated to positions away from the first radial position.

* * * * *